US006889534B2

(12) United States Patent
Koluch

(10) Patent No.: US 6,889,534 B2
(45) Date of Patent: May 10, 2005

(54) CONTROLLED ACCESS LOCK

(76) Inventor: Thomas M. Koluch, 443 Grindall St., Baltimore, MD (US) 21230

( * ) Notice: Subject to any disclaimer, the term of this patent is extended or adjusted under 35 U.S.C. 154(b) by 39 days.

(21) Appl. No.: 10/440,280

(22) Filed: May 19, 2003

(65) Prior Publication Data

US 2003/0217576 A1 Nov. 27, 2003

Related U.S. Application Data

(60) Provisional application No. 60/383,021, filed on May 23, 2002.

(51) Int. Cl.[7] ..... E05B 27/00

(52) U.S. Cl. ..... 70/493; 70/337; 70/338; 70/341

(58) Field of Search ..... 70/493, 367, 337–343, 70/490–492, 369, 373

(56) References Cited

U.S. PATENT DOCUMENTS 1,650,568 A * 11/1927 Hurd ..... 70/338
2,910,860 A * 11/1959 Moreno ..... 70/338
3,210,973 A * 10/1965 Basseches ..... 70/383
3,298,211 A * 1/1967 Russell et al. ..... 70/369
3,998,080 A * 12/1976 Fane ..... 70/338
5,060,494 A * 10/1991 Moorhouse ..... 70/419
5,209,087 A * 5/1993 Cox ..... 70/369
6,698,264 B1 * 3/2004 Liao ..... 70/493

* cited by examiner

*Primary Examiner*—John B. Walsh
(74) *Attorney, Agent, or Firm*—Law Offices of Royal W. Craig

(57) ABSTRACT

A locking device for controlled, reversible security using a control key to set the lock's accessibility to multiple individual keys, thus providing complete control of security. The control key has hierarchy over the individual key(s). Rotating the control key from the first to a second position prevents the core from being actuated by the individual key(s), thus activating a blocking function by which the lock can only be operated by the control key. Returning the control key from the second position back to the first position allows the control key to be removed ( the blocking function is still active). When the control key is rotated from the first to a third position, the core can be operated by the individual key(s), thus inactivating the blocking function. Returning the control key from the third position to the first position allows removal of the control key (blocking function remains inactive).

26 Claims, 28 Drawing Sheets

26

Cut Point 2

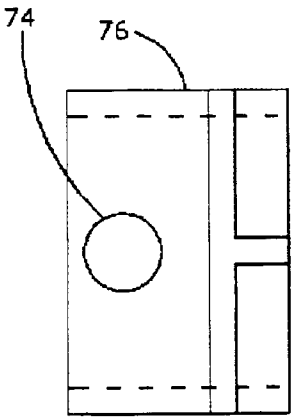
FIG. 27A
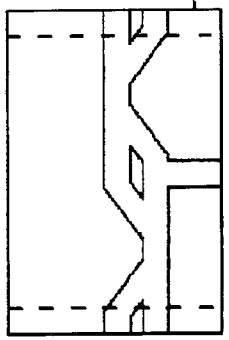
FIG. 27C
FIG. 27B
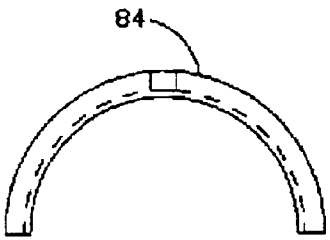
FIG. 27D
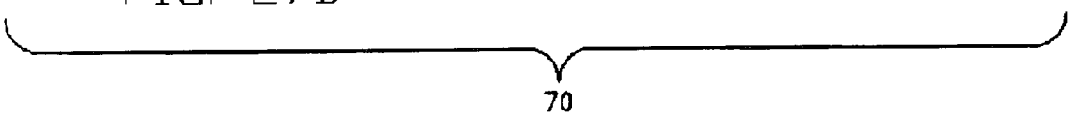

Cut Point 3

Cut Point 4

Cut Point 5

Cut Point 6

CONTROLLED ACCESS LOCK

CROSS-REFERENCE TO RELATED APPLICATIONS

The present application derives priority from U.S. provisional application No. 60/383,021 for "CONTROLLED ACCESS LOCK"; Filed: May 23, 2002; Applicant: Thomas, M. Koluch.

BACKGROUND OF THE INVENTION

1. Field of the Invention

The present invention relates to locking devices for providing secure entry by use of keys and, more particularly, to a controlled-access lock that allows dual-control by a user key as well as a control key to give complete owner control and security within an immediate time frame.

2. Description of the Background

There is a commercial need to provide controlled key-access security using a control key that sets a lock's accessibility to individual keys, thus providing the owner/operator of a premises with complete control of security. For example, if a tenant key is lost or stolen, the landlord typically must have the door lock replaced at significant expense. This situation is especially acute in multiple-unit buildings such as apartments and office buildings. Electronic key systems now exist to allow an owner to selectively permit one key card to open each lock and not the other key cards. However, these systems are cost prohibitive for many business and residential applications. There currently is no mechanical lock equivalent to provide a cost-effective solution.

There have, however, been a few prior efforts to develop a mechanical controlled-access lock. For example, pin tumbler locks which may be rekeyed without removing the tumblers, and therefore rekeyed without a locksmith, are known. U.S. Pat. No. 1,565,556 of Fremon, issued Dec. 15, 1925, and U.S. Pat. No. 2,603,081, of Pelle, issued Jul. 15, 1952 disclose locks which must be removed from the lock assembly in which they have been assembled in order to effect rekeying. Therefore, while those locks may not require a locksmith for rekeying, rekeying would not ordinarily be attempted by someone who is not mechanically inclined. U.S. Pat. No. 5,921,121 to Tang issued Jul. 13, 1999 shows an adjustable key-type spring pin lock cylinder. By turning an adjusting lever (10) the owner can select one of two keys to open the lock. A lock which may be rekeyed from the exterior by a reset key which adjusts the positioning of the tumblers is disclosed, for example, in U.S. Pat. No. Re. 28,319 of Kerr, which was reissued on Jan. 28, 1975 (original patent issued on Sep. 4, 1973). The '319 Kerr Patent discloses an axial pin tumbler lock which includes a number of pin tumbler sets that extend circumferentially about the lock, each of the tumbler sets including three axially-extending tumblers. One set of circumferentially-extending tumblers is rotated relative to the other two sets by the reset key to form new combinations of three tumblers for each tumbler set, thereby rekeying the lock. The reset key must be inserted into the lock in the same angular position relative to the lock that it was in when it was last withdrawn from the lock, otherwise the lock can not be rekeyed. In order to facilitate proper introduction of the reset key, the '319 Kerr Patent suggests that the front of the lock be marked with indicia to identify the positions of the axial tumbler sets. However, such indicia may distinguish the exterior appearance of the lock from a non-rekeyable lock of the same type and thereby suggest that the lock may be re-keyed.

All of the foregoing prior art examples require modification of the entire lock or some special outward indica. Also, the size of the existing designs make their use in common padlocks prohibitive. Furthermore, the control key merely activates the blocking or re-keying mechanisms in these other designs as opposed to actually opening the lock, and thus control keying is extremely limited in the existing patented designs.

It would be greatly advantageous to provide a main body lock assembly that can be used in existing commercial and residential locks and padlocks containing removable main bodies that allow controlled, reversible security using a control key to set the lock's accessibility to multiple individual keys. The control key should act to limit the lock's accessibility, but remain completely functional in operating the lock at all times.

SUMMARY OF THE INVENTION

It is, therefore, an object of the present invention to provide a main body assembly for commercial and residential locks and padlocks that allows controlled, reversible security using a control key to set the lock's accessibility to multiple individual keys, thus providing the owner/operator complete control of security.

It is another object to provide a main body assembly for commercial and residential locks and padlocks as described above that simplifies installation, thereby allowing a broad range of existing locks to be retrofitted without necessitating a total lock replacement.

It is another object to provide a main body assembly for commercial and residential locks and padlocks as described above in which the control key serves to limit the lock's accessibility, and yet remains completely functional in operating the lock itself.

In accordance with the above-described objects, disclosed herein is a configuration for a locking device for controlled, reversible security using a control key to set the lock's accessibility to multiple individual keys, thus providing complete control of security. The control key has hierarchy over the individual key(s). Rotating the control key from the first to a second position prevents the core from being actuated by the individual key(s), thus activating a blocking function by which the lock can only be operated by the control key. Returning the control key from the second position back to the first position allows the control key to be removed (the blocking function is still active). When the control key is rotated from the first to a third position, the core can be operated by the individual key(s), thus inactivating the blocking function. Returning the control key from the third position to the first position allows removal of the control key (blocking function remains inactive).

Two embodiments of the locking device are disclosed. Both embodiments are based on a main body assembly that is uniform in size to match existing assemblies, thereby allowing retrofit of existing locks. In both embodiments, the lock can be operated by multiple "A" or individual key(s), or by a "Z" key, which is a control key. These keys are inserted and removed from a core with a cylinder in a first position. The Z key has hierarchy over the A key(s). Rotating the Z key from the first to a second position prevents the core from being actuated by the A key(s), thus activating a blocking function. At this point, the lock can only be operated by the Z key. Returning the Z key from the second position back to the first position allows the Z key to be removed from the core (the blocking function is still active). When the Z key is rotated from the first to a third position, the core can be operated by the A key(s), thus inactivating the blocking function. Returning the Z key from the third position back to the first position allows for removal of the Z key from the core (blocking function remains inactive).

The preferred embodiment accomplishes the foregoing with a main body assembly including a shell-housing, a first set of tumblers and a second set of tumblers all loaded into corresponding bore(s) in the shell, a stationary drive pin, and a cylinder including a core and a multi-piece sleeve. This allows use of multiple individual keys and a single control (or master) key. An individual key inserted into the core aligns the gaps (or breaks) between the first tumblers and the second tumblers with a first shear line allowing rotation of the core and operation of the lock. When the control key is inserted into the core it aligns the gaps/breaks between the first tumblers and the second tumblers with a second shear line such that rotation of the control key to a first position allows for insertion and removal of the individual keys, and to a second position activates a blocking function preventing use of the individual keys, and to a third position that disables the blocking function. An alternate embodiment is also disclosed that is based on the operations of locking pins. Both embodiments are easily re-keyable.

BRIEF DESCRIPTION OF THE DRAWINGS

Other objects, features, and advantages of the present invention will become more apparent from the following detailed description of the preferred embodiment and certain modifications thereof when taken together with the accompanying drawings in which:

FIGS. 27A, 27B, 27C & 27D are a bottom view, top view and end view, respectively, of the multi-piece sleeve showing one bore.

DETAILED DESCRIPTION OF THE PREFERRED EMBODIMENTS

Figure 1:
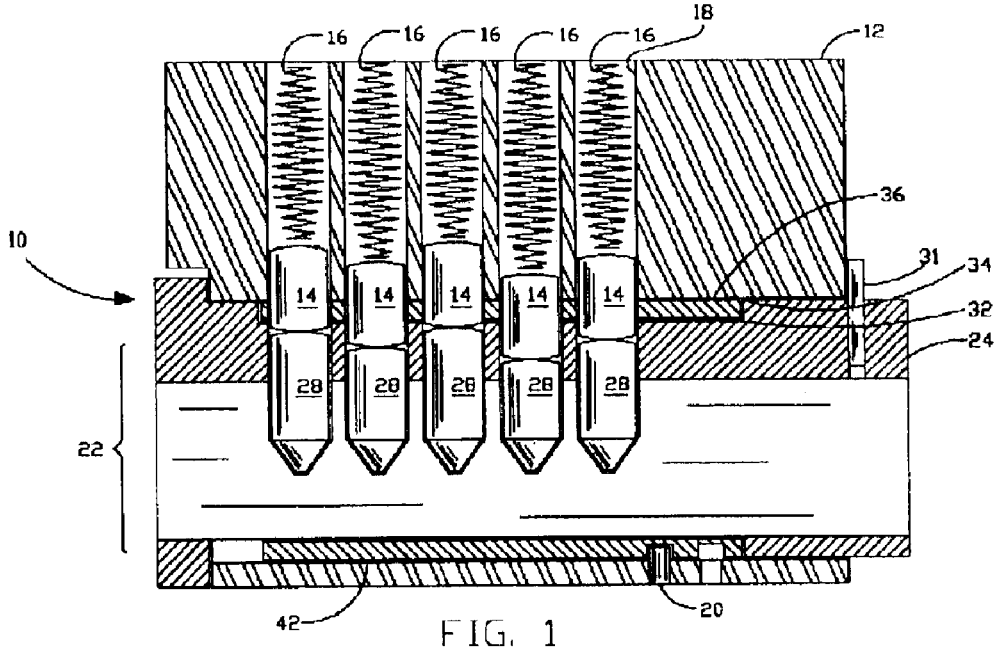
FIG. 1 is a part-sectional view of the main body according to a preferred embodiment of the present invention with blocking function, at the front, inactivated in first position.
Figure 3A:
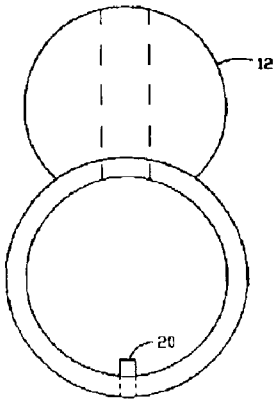
FIGS. 3A and 3B are a bottom view and end view, respectively, of the main body of FIGS. 1 & 2 showing one stationary drive pin.
Figure 3B:
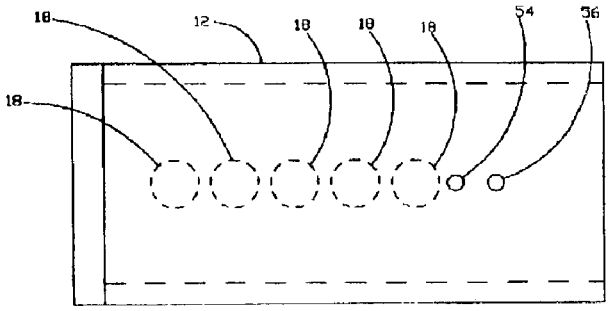

A preferred main body assembly in accordance with the invention is shown in FIG. 1 and is designated generally by numeral 10. The main body assembly includes a shell 12 that houses all of the components as presented in FIG. 1. The components are comprised of tumblers 14 and tumbler springs 16 housed in bores 18 in shell 12 (see also FIGS. 3A & 3B), a stationary drive pin 20, and a cylinder 22 (see also FIG. 4).

Figure 4:
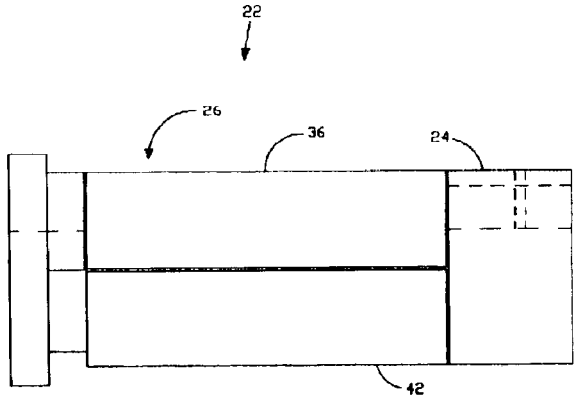
FIG. 4 is a side view of the cylinder with blocking function, at the front, inactivated.
Figure 5A:
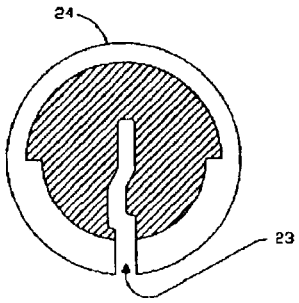
FIGS. 5A and 5B are a side view and perpendicular sectional view, respectively, of the core uniformly recessed across all bores with the blocking function at the front.
Figure 5B:
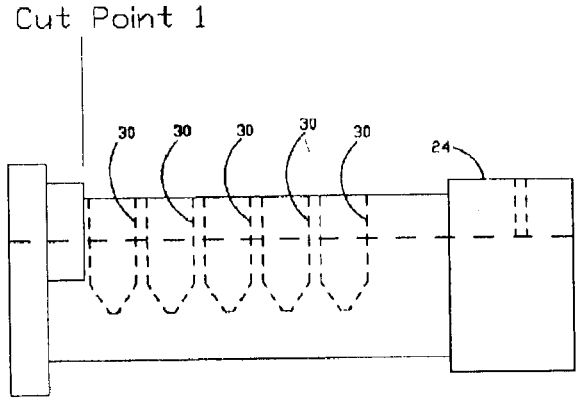

As best seen in FIG. 4, the cylinder 22 is comprised of a core 24 encircled by a multi-piece sleeve 26, the sleeve being a hollow cylindrical component comprised of at least two pieces: a top portion 36 and a bottom portion 42. Referring back to FIG. 1, the core 24 houses a plurality of drive tumblers 28 in bores 30 which are machined into core 24, and also houses a core retaining pin 31 (see also FIG. 5B). As seen in FIG. 5A, the core 24 is also defined by a keyslot 23 which accepts the keys (not shown). FIG. 5B is a side view of the core 24 which illustrates the recess in which multi-piece sleeve 26 is seated. Note that the upper recess closely conforms to the top sleeve portion 36, but the lower recess is longer than the bottom sleeve portion 42 to provide room for a shift.

Referring back to FIG. 1, the multi-piece sleeve 26 is separated from the core 24 by a first shear line 32, and is separated from the main body 12 by a second shear line 34. The sleeve upper portion 36 also has bores 38 (see FIGS. 6A & 6B) to accept both the drive tumblers 28 and tumblers 14.

Figure 7:
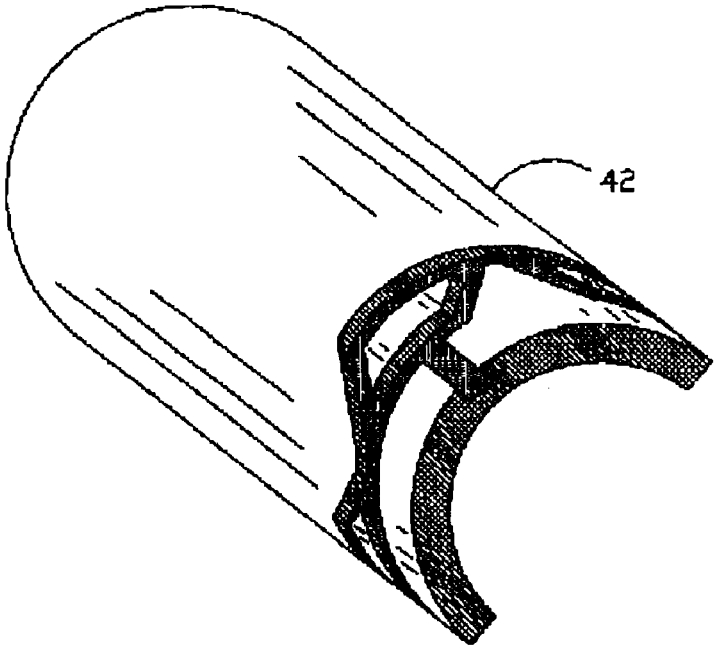
FIG. 7 is an isometric view of the top portion of the multi-piece sleeve.
Figure 6C:
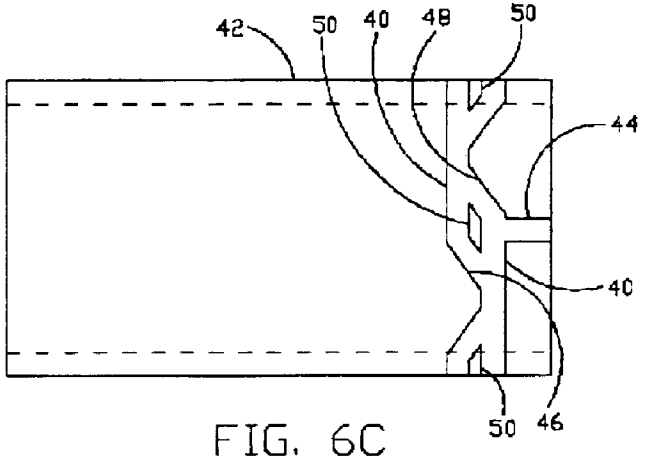
FIGS. 6A–D are a top view, bottom view and end view, respectively, of the multi-piece sleeve.
Figure 6D:
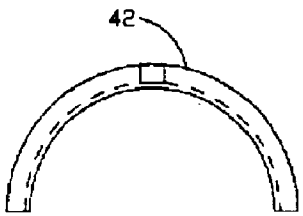
Figure 6A:
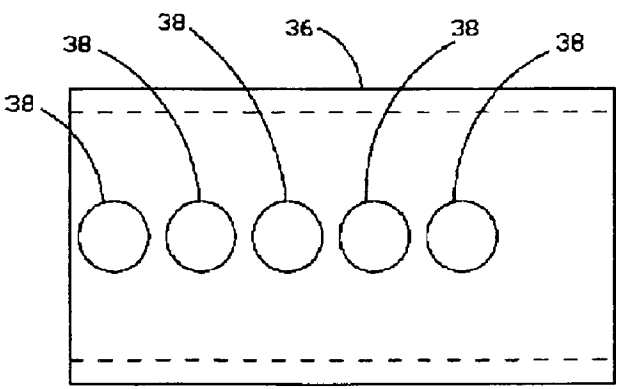
Figure 6B:
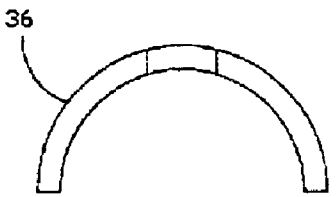

As seen in FIGS. 6C & 6D and 7, the multi-piece sleeve 26 has a guide channel 40 formed in one or both of the upper portion 36 and/or lower portion 42, the channel 40 being shown in the lower portion 42 in the illustrated embodiment. The guide channel 40 further comprises an entrance/exit channel 44; ramps which are referred to as inclines 46, 48; and barriers 50. Referring back to FIG. 1, the stationary drive pin 20 is fixed to the main body 12 and extends into the channel 40 of the multi-piece sleeve 26.

The operation of the controlled-access lock according to the present invention will now be described with reference to FIGS. 8–16. The controlled-access lock allows dual-control by a user key A as well as a control key Z.

Figure 8:
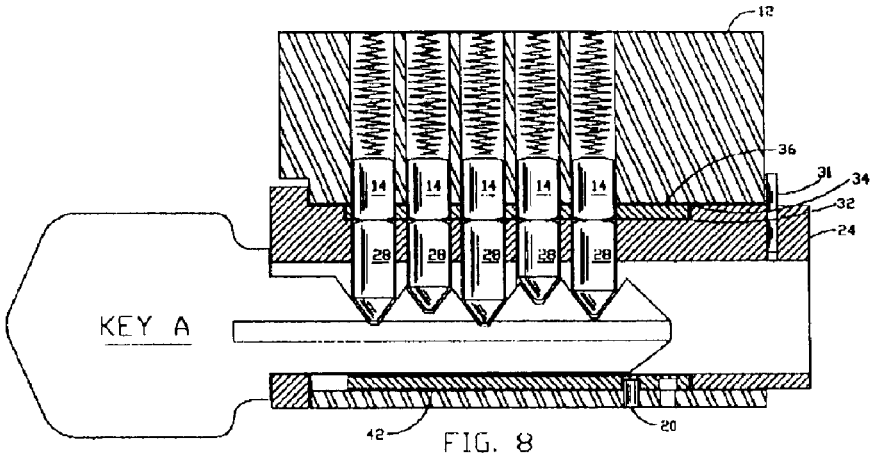
FIG. 8 is a part-sectional view with A key inserted, of the main body of FIGS. 1–3B, with blocking function inactivated in first position.

As seen in FIG. 8, when the A key(s) is inserted into the core 24 (directly into an initial first position), it aligns the gaps/breaks between the drive tumblers 28 and the tumblers 14 with shear line 32.

Figure 9:
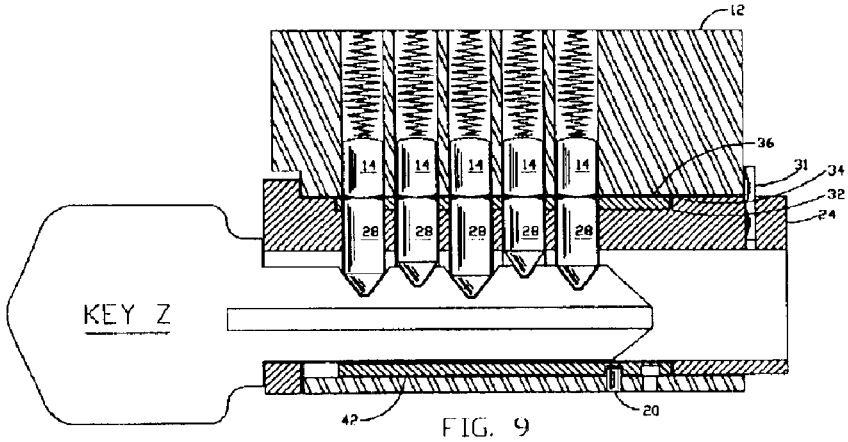
FIG. 9 is a part-sectional view with control key (Z) inserted, of the main body of FIGS. 1–3B, with blocking function inactivated in first position.

As seen in FIG. 9, when the Z key is inserted into the core 24 (first position only), it aligns the gaps/breaks between both the drive tumblers 28 and tumblers 14 with shear line 34. As the Z key is rotated the entire cylinder 22 (inclusive of core 24 and multi-piece sleeve 26) rotates. This is due to the gaps/breaks between both the drive tumblers 28 and tumblers 14 being in alignment with shear line 34 and not in alignment with shear line 32.

Figure 10:
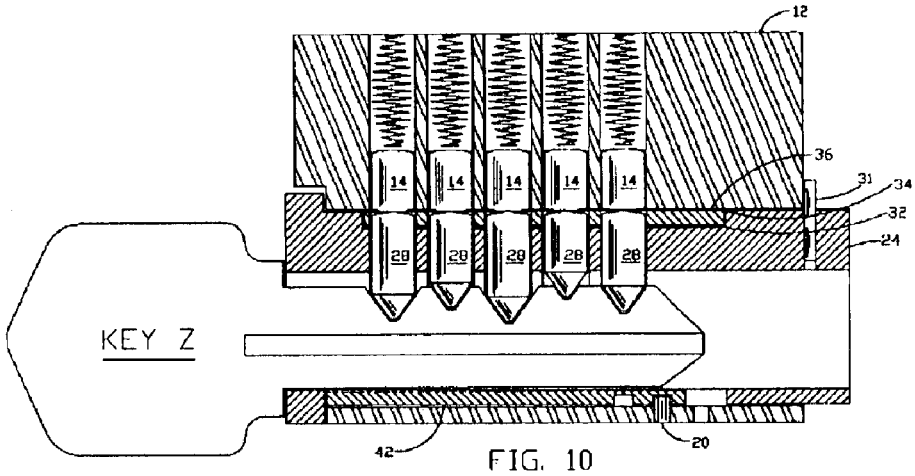
FIG. 10 is a part-sectional view as shown in FIG. 9 with blocking function activated in first position.
Figure 13:
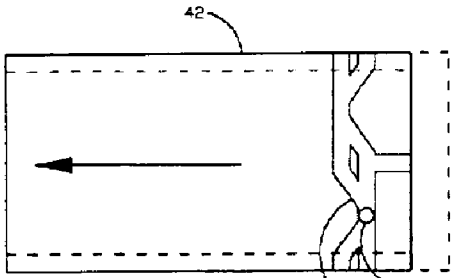
FIG. 13, is a bottom view of the multi-piece sleeve as shown in FIG. 12, with blocking function activated and in the second position.
Figure 12:
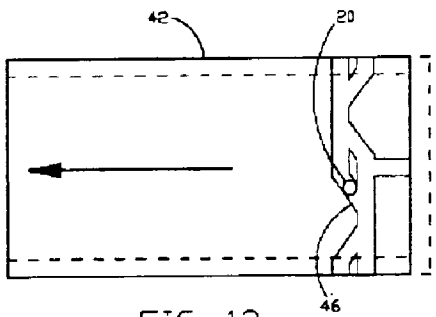
FIG. 12 is a bottom view of the multi-piece sleeve as shown in FIG. 11, with the blocking function partially activated and approaching the second position.

As seen in FIG. 10, rotation of the Z key to a second position causes the bottom portion of the multi-piece sleeve 42 to shift forward due to the stationary drive pin 20 engaging the incline 46 in the channel 40 of the bottom portion of the multi-piece sleeve 42. Thus, use of the Z key to initiate this shift in the bottom portion of the multi-piece sleeve 42 activates the blocking function by which the A key(s) is inoperable.

FIGS. 11, 12, 13, 14 and 15 depict the various positions of the stationary drive pin 20 with respect to the incline 46 as the Z key is rotated from the first position (see FIG. 11) to the second position (see FIG. 13) and back to the first position (see FIG. 15), thereby activating the blocking function.

Figure 16:
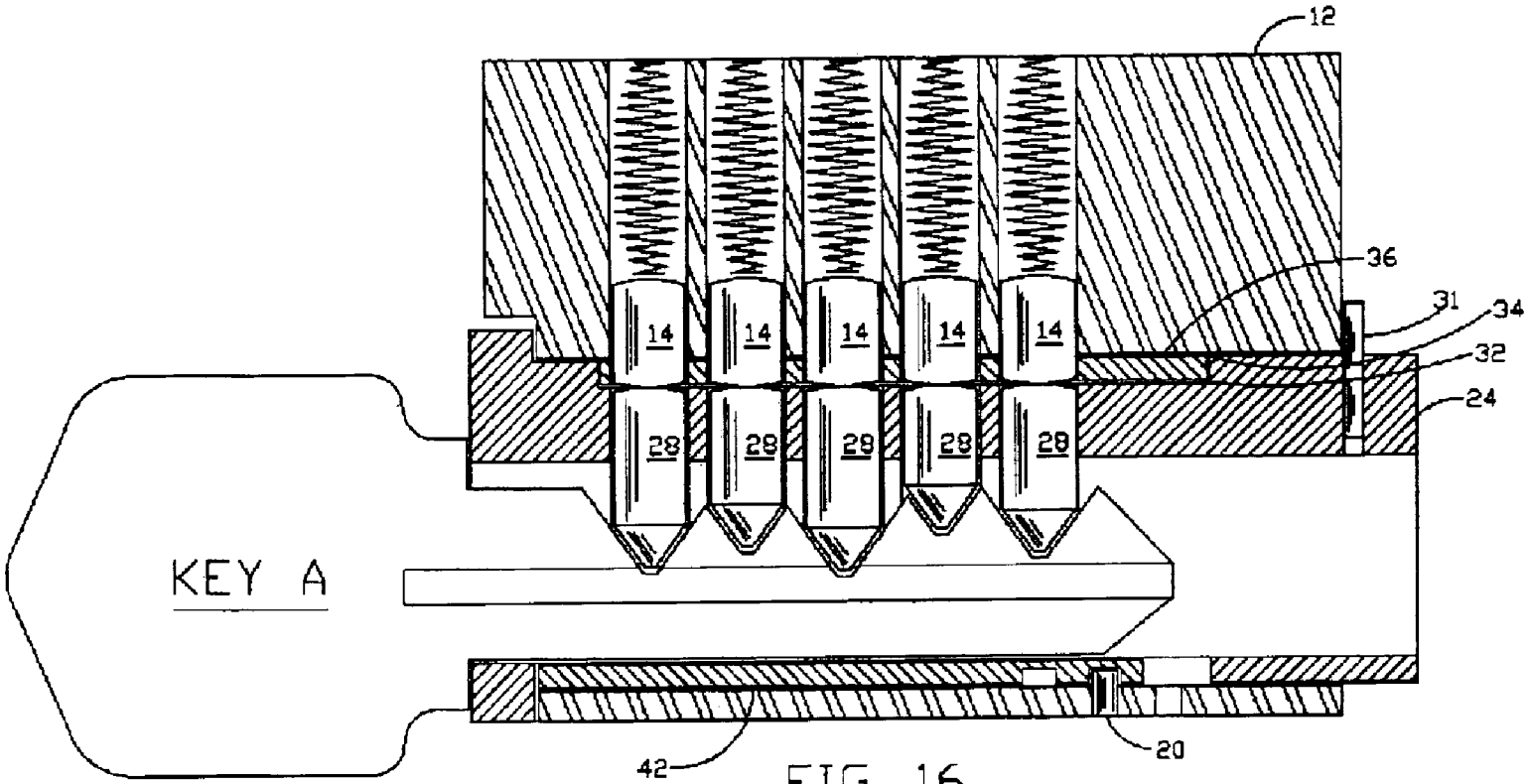
FIG. 16 is a part-sectional view with A key inserted, as shown in FIG. 10, with blocking function activated in first position.
Figure 19:
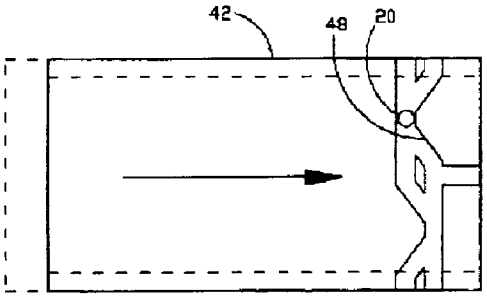
FIG. 19 is a bottom view of the multi-piece sleeve bottom portion as shown in FIG. 18, with the blocking function inactivated and in the third position.
Figure 18:
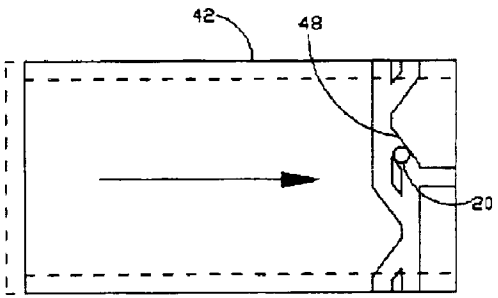
FIG. 18 is a bottom view of the multi-piece sleeve bottom portion as shown in FIG. 17, with the blocking function partially activated and approaching the third position.

With combined reference to FIGS. 5A & 5B, the lower recess in core 24 accepts the forward longitudinal shift in the bottom portion of the multi-piece sleeve 42 thereby rotatably locking the core 24 to the multi-piece sleeve 26 and making the A key(s) inoperable. Normally the A key(s) would be allowed to rotate the core 24, however due to the activated blocking function, the A key(s) is inoperable as seen in FIG. 16.

To deactivate the blocking function, the Z key is inserted in the core 24 (thereby aligning the gaps/breaks between drive tumblers 28 and tumblers 14 with shear line 34 (see FIG. 10) and is rotated from a first position to a third position and back to the first position. Rotating the Z key to the third position causes the bottom portion of the multi-piece sleeve 42 to slide back to the rear as seen in FIG. 9 (as before, the stationary drive pin 20 engages the incline 48 in the channel 40 of the bottom portion of the multi-piece sleeve 42), and this deactivates the blocking function.

FIGS. 17, 18, 19, 20 and 21 show the position of the stationary drive pin 20 with respect to the incline 48 as the Z key is rotated from the first position (FIG. 17) to the third position (FIG. 19) and back to the first position (FIG. 21), thereby deactivating the blocking function.

Figure 11:
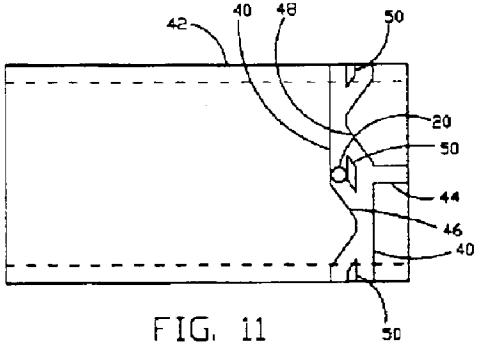
FIG. 11 is a bottom view of the multi-piece sleeve bottom portion with the blocking function inactivated in the first position.
Figure 15:
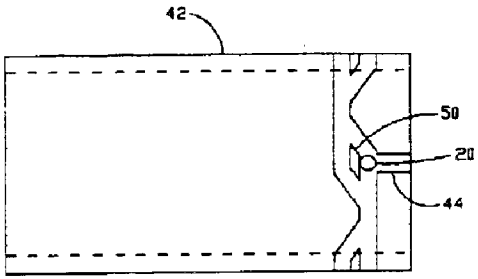
FIG. 15, is a bottom view of the multi-piece sleeve as shown in FIG. 14, with blocking function activated and in the first position.
Figure 14:
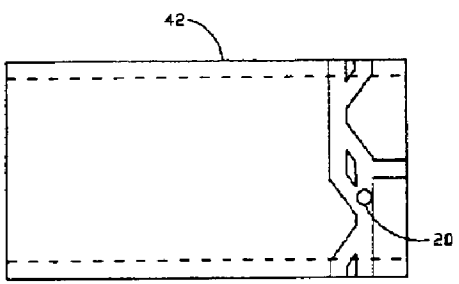
FIG. 14, is a bottom view of the multi-piece sleeve as shown in FIG. 13, with blocking function activated and approaching the first position.
Figure 17:
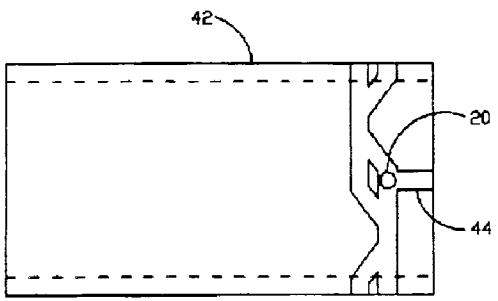
FIG. 17 is a bottom view of the multi-piece sleeve bottom portion with the blocking function activated and in the first position.
Figure 21:
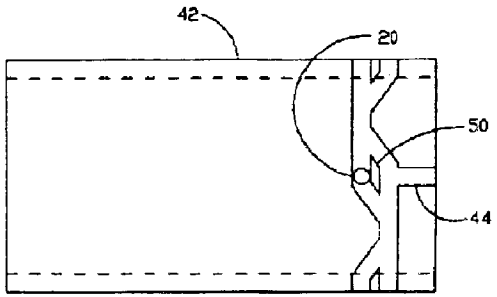
FIG. 21 is a bottom view of the multi-piece sleeve bottom portion as shown in FIG. 20, with the blocking function inactivated and in the first position.
Figure 20:
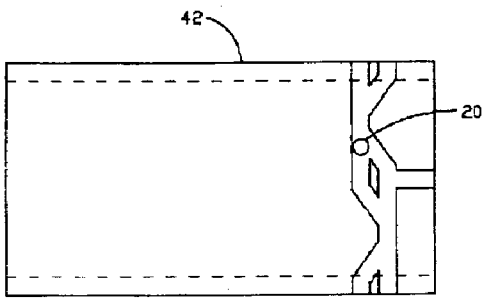
FIG. 20 is a bottom view of the multi-piece sleeve bottom portion as shown in FIG. 19, with the blocking function inactivated and approaching the first position.

Afterward, the Z key is removed and the A key(s) is inserted aligning the gaps/breaks between the drive tumblers 28 and tumblers 14 to shear line 32 (FIG. 8). This allows the A Key(s) to rotate the core 24 thus operating the lock. Longitudinal movement of the bottom portion of the multi-piece sleeve 42 can only occur when the cylinder 22 is rotated (Z key). This is due to the stationary drive pin 20 engaging the inclines 46, 48 within the channel 40. The inactivated blocking function is best seen in FIGS. 1, 11, with the cylinder 22 in the first position. Notice that the stationary drive pin 20 rests in the channel 40 with a barrier 50 to the rear of the stationary drive pin 20 thus isolating it from an adjacent channel 40. This barrier 50 prevents unwanted forward longitudinal movement of the bottom portion of the multi-piece sleeve 42, insuring that the blocking function remains inactive until otherwise determined by the rotation of the Z key. FIG. 17 shows the barrier 50 preventing unwanted longitudinal backward movement of the bottom portion of the multi-piece sleeve 42, thus insuring that the blocking function remains active.

FIGS. 11 and 17 also reveal an entrance/exit channel 44 which is used to remove the cylinder 22 from the main body 12. Notice in FIG. 11 that the entrance/exit channel 44 is not exposed to the stationary drive pin 20, thereby preventing removal of the cylinder 22. FIG. 17 reveals that the entrance/exit channel 44 is exposed to the stationary drive pin 20 thus allowing for the cylinder's removal.

Figure 22A:
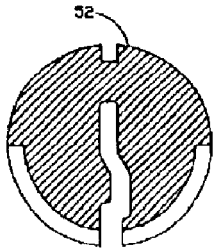
FIGS. 22A and 22B are a side view and perpendicular sectional view, respectively, of the core uniformly recessed across all bores with the blocking function at the rear.
Figure 22B:
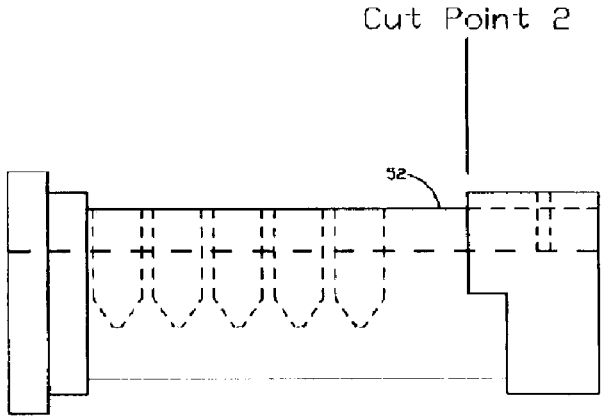

It should be understood that the foregoing description is for illustrative purposes and obvious variations will occur to those skilled in the art. For example, the blocking function can be placed to the rear of the core 24 rather than the front of the core 24. In this case, the bottom portion of the multi-piece sleeve 42 would have to slide to the rear of the core 52 to activate the blocking function as opposed to the front of the core 24. This is easily accomplished by relocating the stationary driving pin 20 from position 54 to position 56 (see FIGS. 3A & 3B). Also, a core 52 with a cutout located at the rear of the core 52 will have to be used as illustrated in FIGS. 22A and 22B which are a side view and perpendicular sectional view, respectively, of the core 52 uniformly recessed across all bores with the blocking function at the rear.

Figure 2:
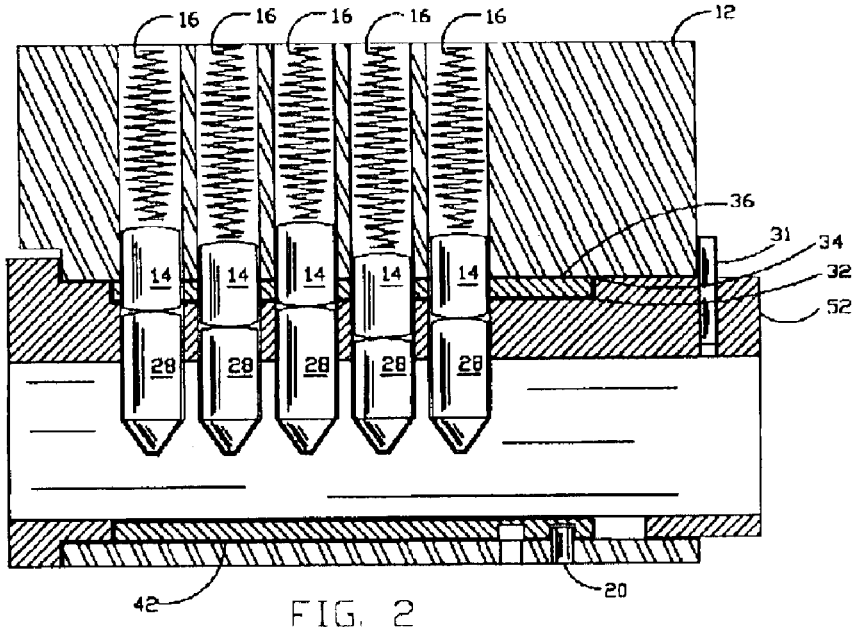
FIG. 2 is a part-sectional view of the main body of FIG. 1 with blocking function, at the rear, inactivated in first position.
Figure 23:
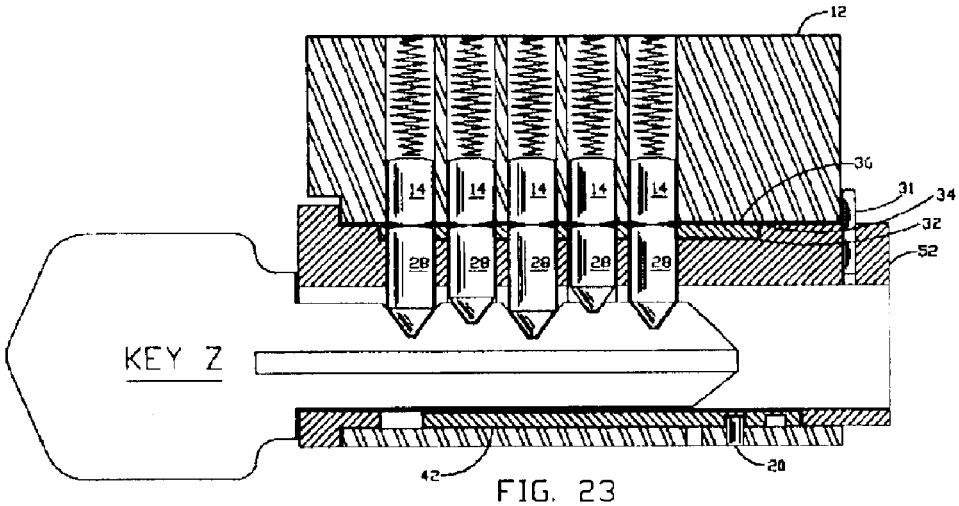
FIG. 23 is a part-sectional view with control key (Z) inserted, as shown in FIG. 2, with blocking function activated in first position.

FIG. 23 is a part-sectional view with control key (Z) inserted, as shown in FIG. 2, with blocking function activated in first position. FIG. 2 depicts the blocking function, at the rear, in the inactive state while FIG. 23 depicts the active state.

Figure 25B:
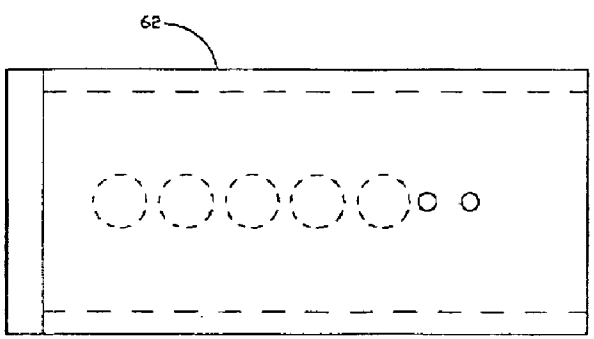
FIGS. 25A & 25B are a bottom view and end view, respectively, of the main body showing two stationary drive pins.
Figure 25A:
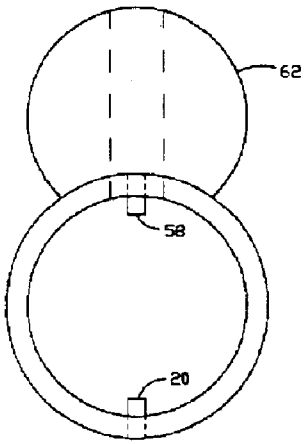
Figure 24A:
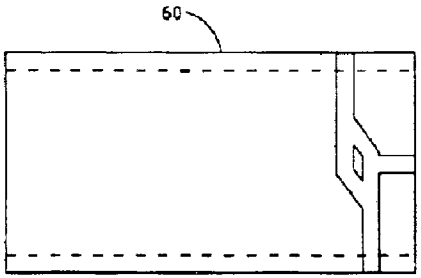
FIGS. 24A & 24B are a bottom view and end view, respectively, of the multi-piece sleeve bottom portion (degree of rotation less than +/−90 degrees).
Figure 24B:
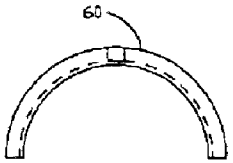

For any lock, in which the +/− rotation is less than +/−90 degrees, such as padlocks, only one stationary drive pin 20 is needed, used in conjunction with either bottom portions of multi-piece sleeves 42, 60 (FIGS. 6C & 6D). FIGS. 24A & 24B are a bottom view and end view, respectively, of the multi-piece sleeve bottom portion (degree of rotation less than +/−90 degrees). However, some main bodies will require the use of two stationary drive pins 20, 58 (each 180 degrees apart), depending on the amount of +/− degrees (0 degree equals first position) that the Z key can be rotated. If the degree of rotation exceeds +/−90 degrees (i.e. mortise cylinders), then two stationary drive pins 20, 58 (located in the main body 62) are necessary, used in conjunction with the bottom portion of multi-piece sleeve 42 (of FIGS. 6C & 6D). FIGS. 25A & 25B are a bottom view and end view, respectively, of the main body showing two stationary drive pins 20, 58.

Figure 26B:
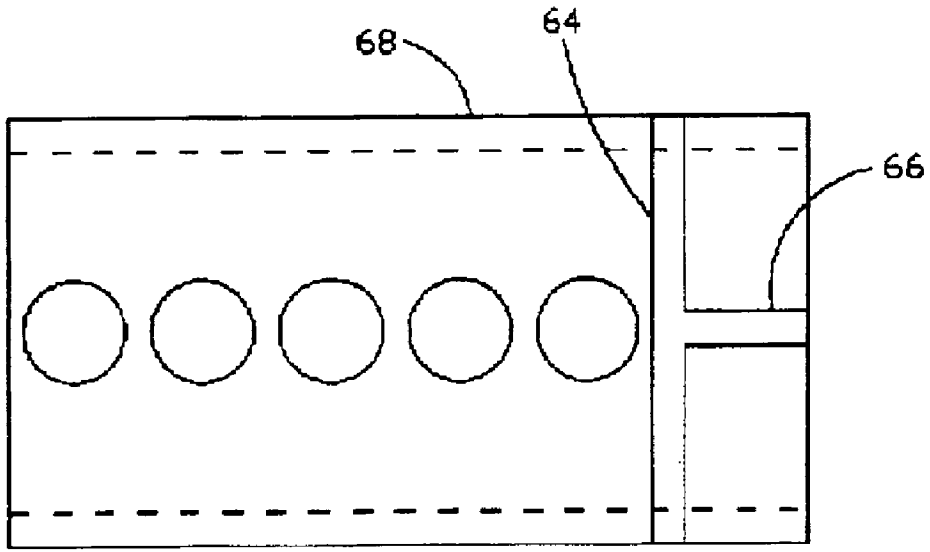
FIGS. 26A & 26B are a top view and end view, respectively, of the multi-piece sleeve top portion showing a channel.
Figure 26A:
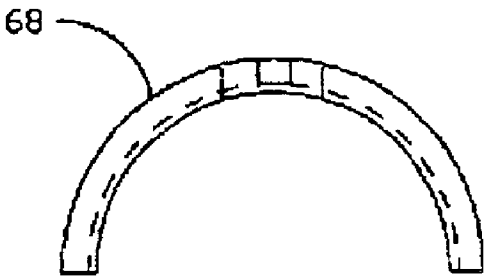

Also, an additional channel 64 (including entrance/exit channel 66) formed into the top portion of the multi-piece sleeve 68 will be needed to accept the stationary drive pins 20, 58. FIGS. 26A & 26B are a top view and end view, respectively, of the multi-piece sleeve top portion showing a channel 64. The reason for the second stationary drive pin 58 is to ensure that one of the two stationary drive pins 20, 58 will always be extended into the channel 40 of the bottom portion of the multi-piece sleeve 42 controlling its longitudinal movement at all times, regardless of the rotational position of the Z key.

Figure 28B:
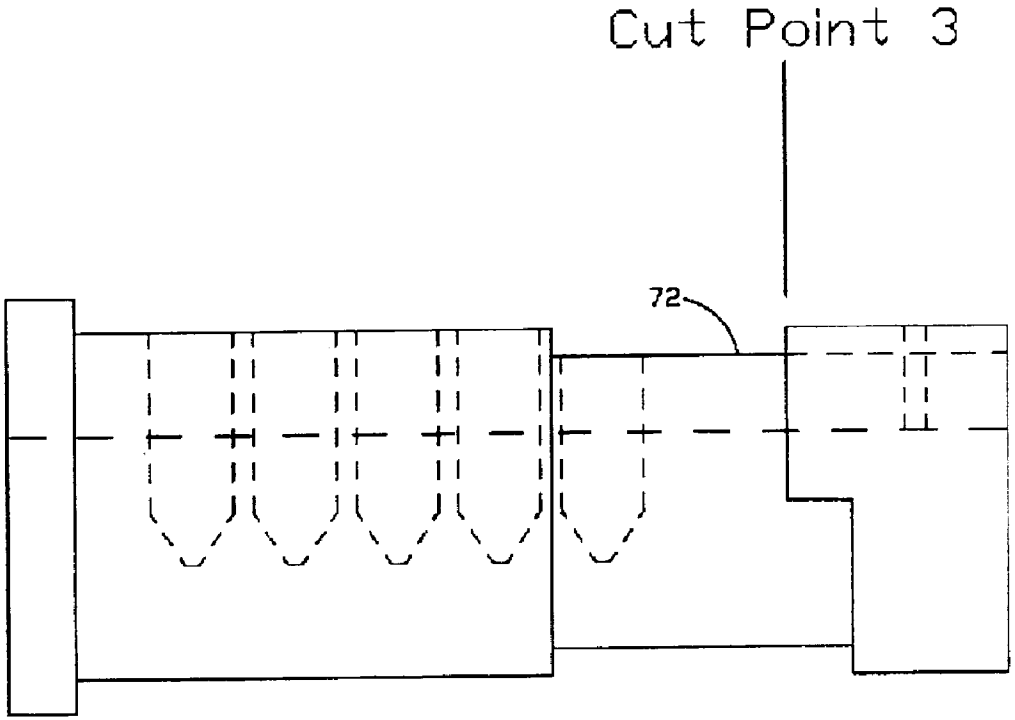
FIGS. 28A & 28B are a side view and perpendicular sectional view, respectively, of the core with blocking function at the rear and showing a shorter longitudinal recess as compared to FIGS. 5A & B.
Figure 28A:
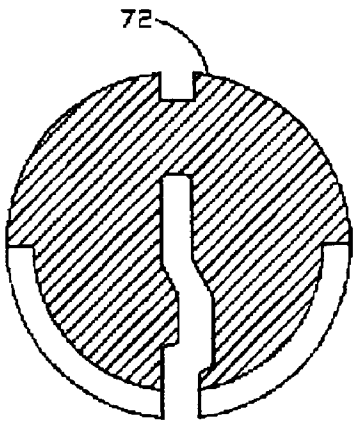
Figure 29B:
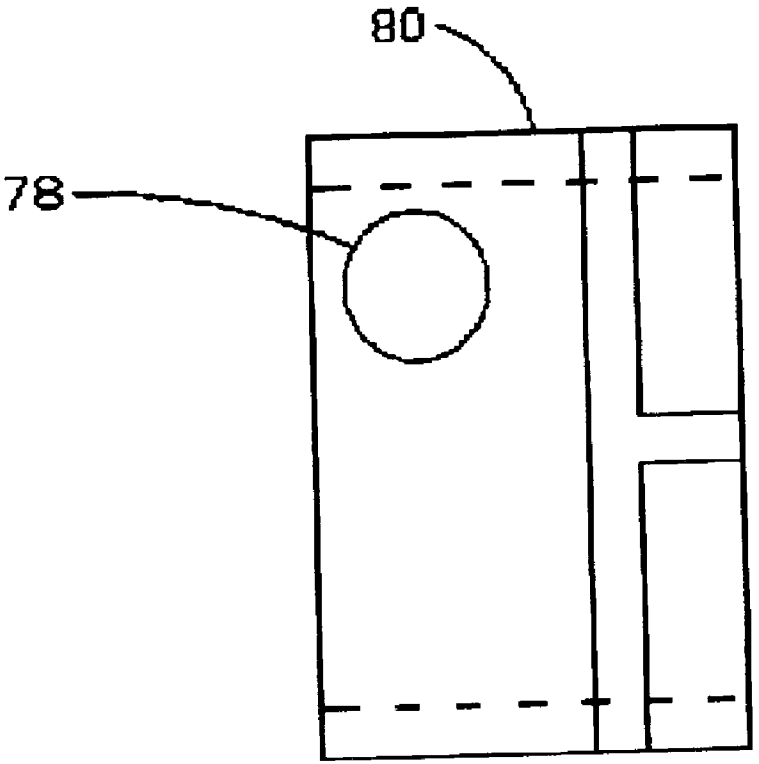
FIGS. 29A & 29B are a top view and end view, respectively, of the top portion of the multi-piece sleeve 26 with the bore offset.
Figure 29A:
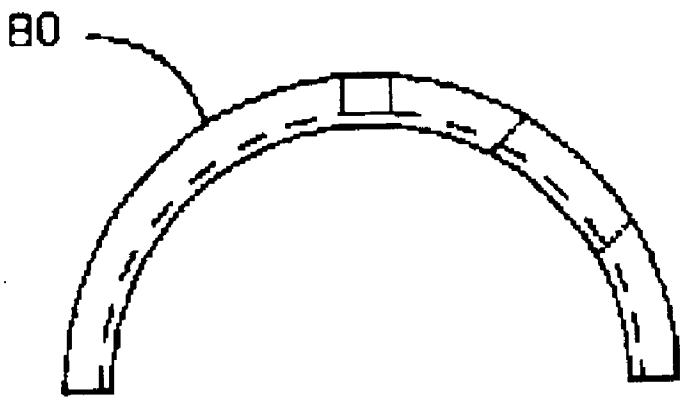
Figure 31B:
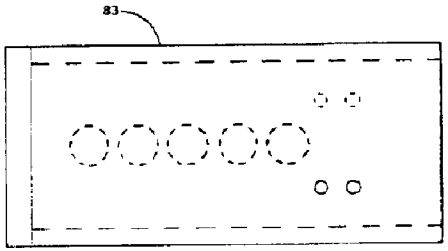
FIGS. 31A & 31B are a bottom view and end view of the main body with the stationary drive pin offset compared to FIGS. 3A & 3B and showing one stationary drive pin.
Figure 31A:
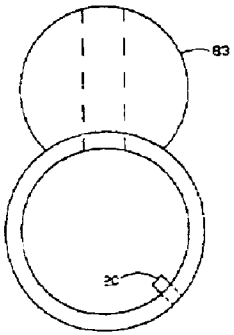
Figure 30B:
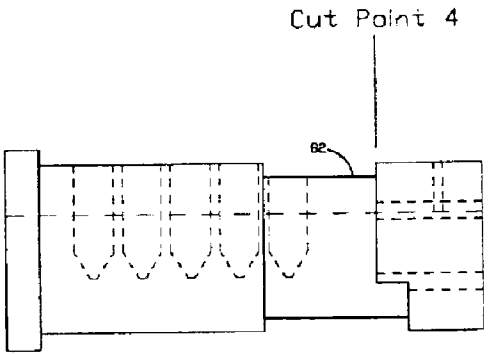
FIGS. 30A & 30B show the core as in FIGS. 28A & 28B, with a blocking function that is offset.
Figure 30A:
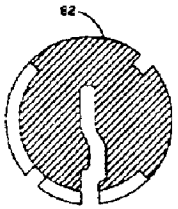
Figure 32B:
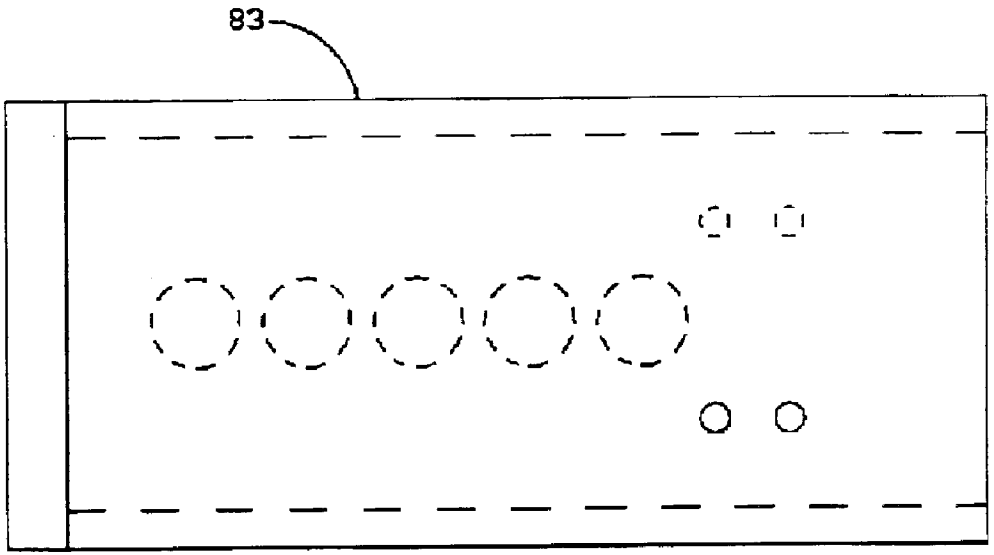
FIGS. 32A & 32B are a bottom view and end view of the main body, respectively, with the stationary drive pins offset compared to FIGS. 25A & B and utilizing two stationary drive pins.
Figure 32A:
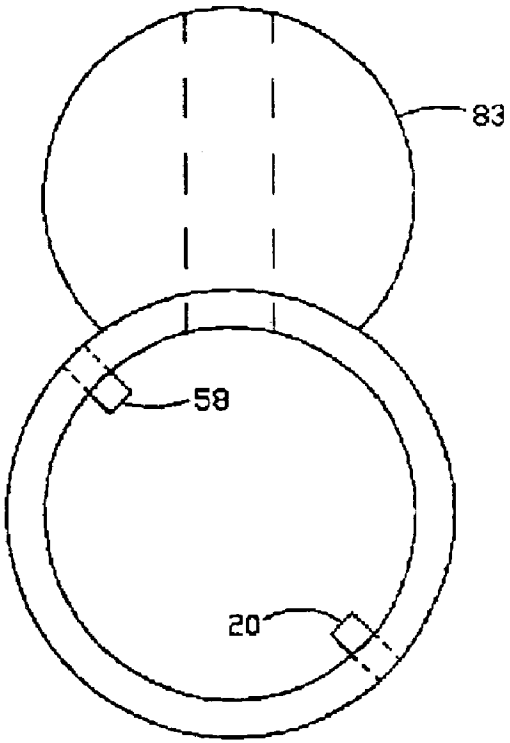

It is also noteworthy that the top portion of the multi-piece sleeve 36, 68, as demonstrated, interacts with all of the drive tumblers 28 and tumblers 14 (FIGS. 26A & 26B). This does not have to be the case. The same goal can be achieved by using a multi-piece sleeve 70 that interacts with a minimum of one drive tumbler 28 and tumbler 14. For example, this can be achieved by using the multi-piece sleeve 70 of FIGS. 27A, 27B, 27C & 27D, which are a bottom view, top view and end view, respectively, of the multi-piece sleeve 70 showing one bore 74. FIGS. 28A & 28B are a side view and perpendicular sectional view, respectively, of the matching core 72 with blocking function at the rear and showing a shorter longitudinal recess as compared to that of FIGS. 5A & B. Additionally, the bore 74 in the top portion of the multi-piece sleeve 76 is shown at the center of the sleeve 76 (see FIGS. 27A & 27B). The bore 78 can be offset from the center of the sleeve 80, and FIGS. 29A & 29B are a top view and end view, respectively, of the top portion of the multi-piece sleeve 80 with the bore offset. If the bore 78 is offset, the cut-out in the back portion of the core 82 (FIGS. 30A & 30B) will also have to be offset the same amount to accommodate the longitudinal movement of the bottom portion of the multi-piece sleeve 84. The stationary drive pins 20, 58 would also have to be relocated within the main body 83 to accommodate the offset, and FIGS. 31A & 31B are a bottom view and end view of the main body with the stationary drive pin 20 offset (as compared to FIGS. 3A & 3B). Note that FIGS. 31A & 31B show one stationary drive pin, while FIGS. 32A & 32B are a bottom view and end view of the main body 83, respectively, with two offset stationary drive pins 20, 58.

Figure 33B:
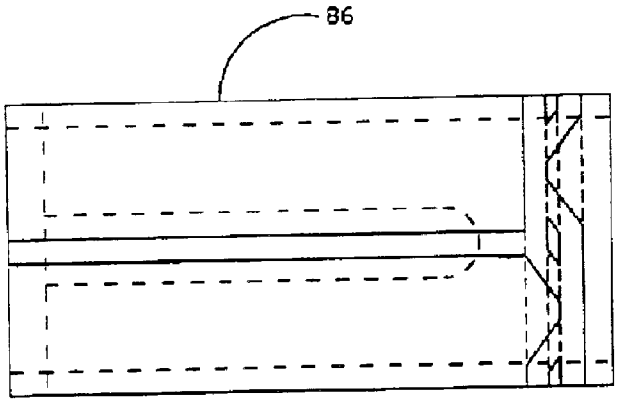
FIGS. 33A, 33B and 33C are a top view, bottom view and end view, respectively, of the single piece sleeve.
Figure 33C:
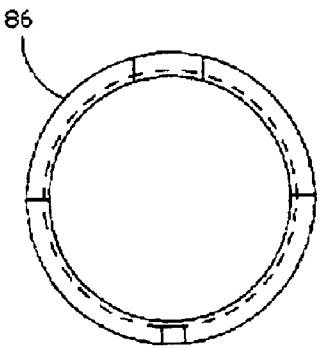
Figure 33A:
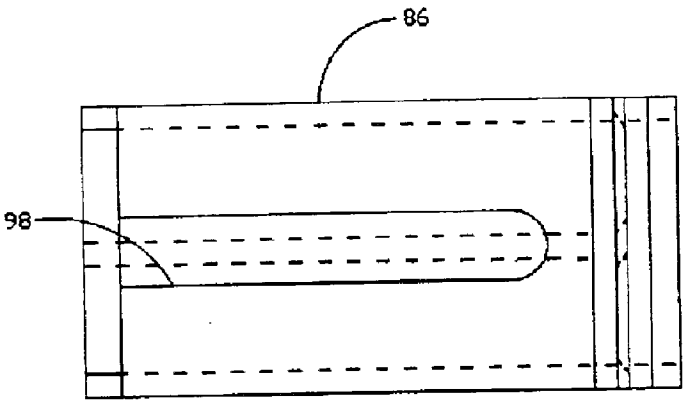
Figure 34B:
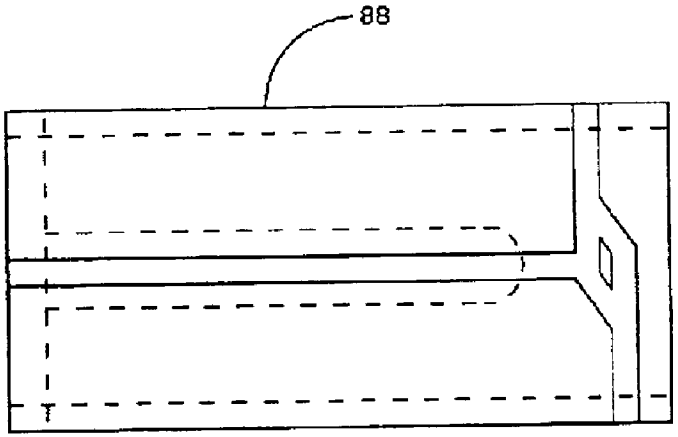
FIGS. 34A, 34B and 34C are a top view, bottom view and end view, respectively, of the single piece sleeve (degree of rotation less than +/−90 degrees).
Figure 34A:
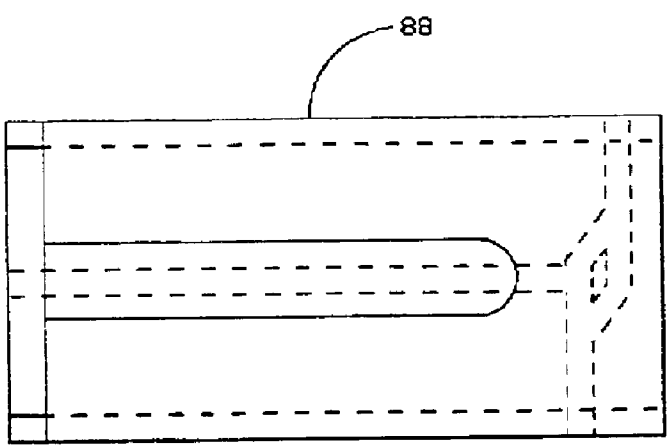
Figure 34C:
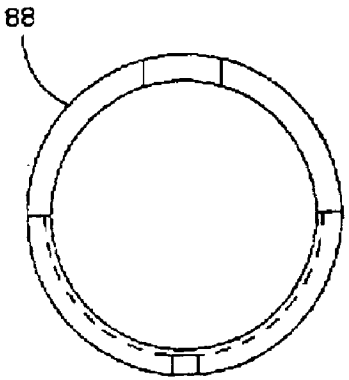
Figure 35B:
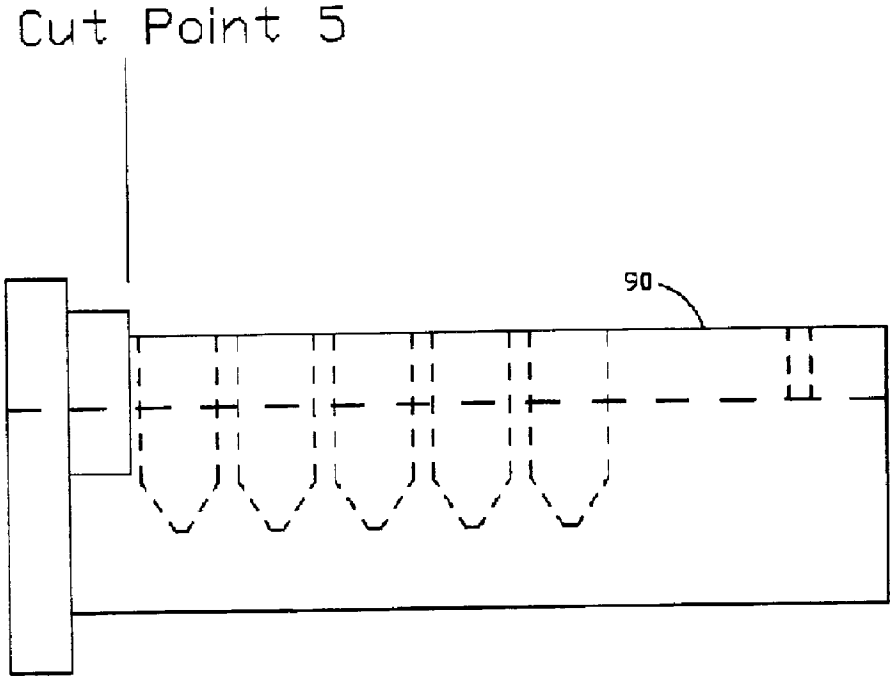
FIGS. 35A and 35B are a side view and perpendicular sectional view, respectively, of the core uniformly recessed across all bores and through to the rear of the core with the blocking function at the front.
Figure 35A:
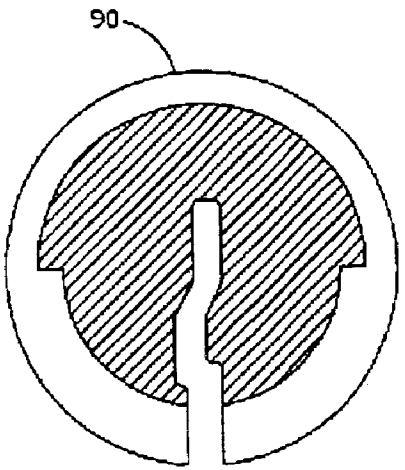
Figure 37B:
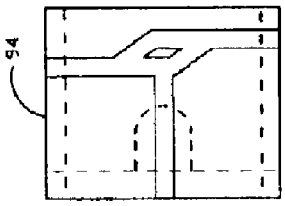
FIGS. 37A, 37B and 37C are a top view, bottom view and end view, respectively, of the single piece sleeve depicting a shorter longitudinal length as compared to FIGS. 34A–C (degree of rotation less then +/−90 degrees).
Figure 37C:
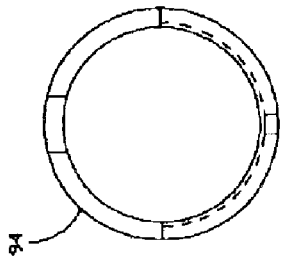
Figure 37A:
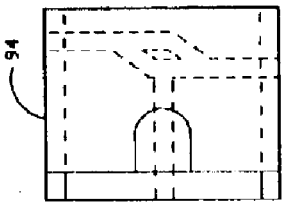
Figure 36B:
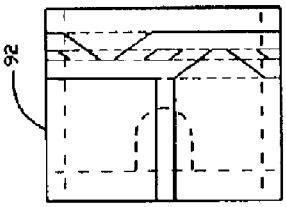
FIGS. 36A, 36B and 36C are a top view, bottom view and end view, respectively, of the single piece sleeve depicting a shorter longitudinal length as compared to FIGS. 33A–C.
Figure 36C:
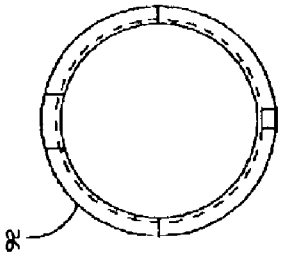
Figure 36A:
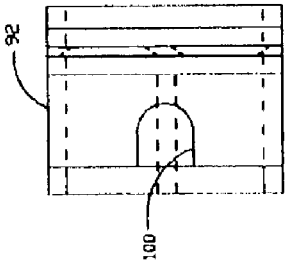
Figure 38B:
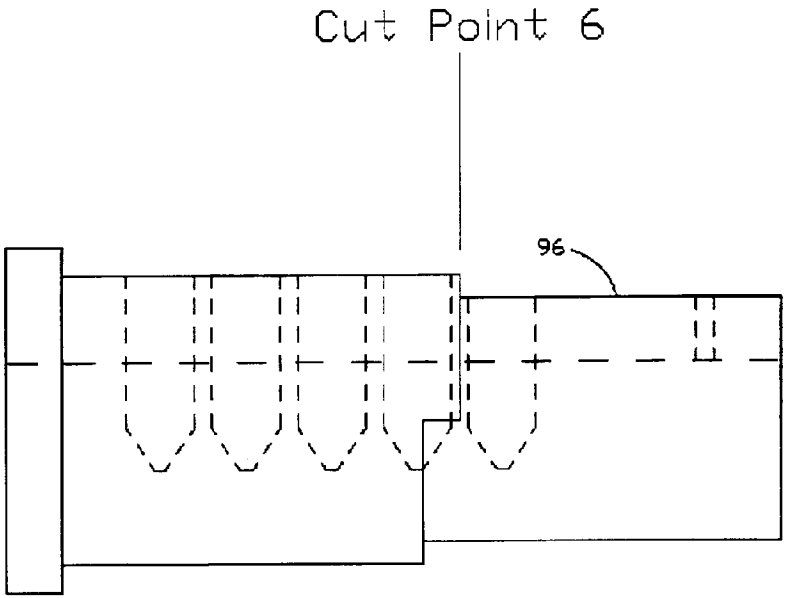
FIGS. 38A & 38B are a side view and perpendicular sectional view, respectively, of the core with blocking at the front showing a shorter longitudinal recess as compared to FIGS. 35A, B.
Figure 39B:
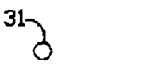
FIGS. 39A and 39B are a side view and end view, respectively, of a core retaining pin.
Figure 38A:
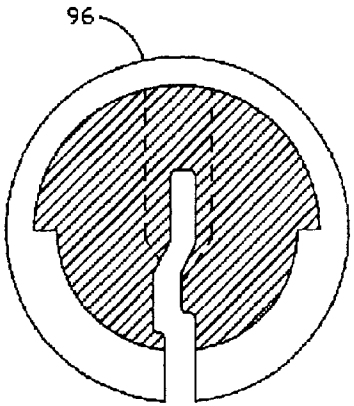
Figure 39A:
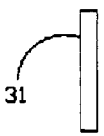

Another design modification can be achieved by replacing the multi-piece sleeve with a single piece sleeve 86, 88 (FIGS. 33A, 33B and 33C are a top view, bottom view and end view, respectively, of the single piece sleeve 86 with degree of rotation greater than +/−90 degrees, and FIGS. 34A, 34B and 34C are a top view, bottom view and end view, respectively, of the single piece sleeve with degree of rotation less than +/−90 degrees) used with a matching core 90 (FIGS. 35A and 35B are a side view and perpendicular sectional view, respectively, of the matching core 90 uniformly recessed across all bores and through to the rear of the core with the blocking function at the front). Alternatively, single piece sleeves 86 or 88 can be used. FIGS. 36A, 36B and 36C are a top view, bottom view and end view, respectively, of the single piece sleeve 92 depicting a shorter longitudinal length as compared to FIGS. 33A–C. FIGS. 37A, 37B and 37C are a top view, bottom view and end view, respectively, of the single piece sleeve 94 depicting a shorter longitudinal length as compared to FIGS. 34A–C (degree of rotation less then +/−90 degrees). In either case, the single piece sleeves 92 or 94 are used with a matching core 96 (FIGS. 38A & 38B are a side view and perpendicular sectional view, respectively, of the matching core 96 with blocking at the front showing a shorter longitudinal recess as compared to FIGS. 35A, B). This modification still provides the same locking and unlocking functions as previously detailed. However, the single piece sleeve allows for the use of only one stationary drive pin 20 regardless of the control key's degree of rotation. The design modification is achieved by using a single piece sleeve 86, 88 along with a matching core 90 that interacts with all of the drive tumblers 28 and tumblers 14 (FIGS. 33A–C, 34A–C; note the depicted longitudinal slot 98 that accommodates all drive tumblers 28 and tumblers 14). The same can also be achieved by using a single piece sleeve 92, 94 with a matching core 96 that interacts with a minimum of one drive tumbler 28 and tumbler 14 (FIGS. 36A–C, 37A–C, note the longitudinal slot 100 that accommodates one drive tumbler 28 and tumbler 14). Thus, although a separate single piece sleeve would be required to accommodate either a less than or greater than +/−90 degree of rotation, the matching core would not require modification to accommodate the rotational requirements. (Note: FIGS. 35A–B and 38A–B show cores 90, 96 with the blocking function to the front of the cores 90, 96). The cores 24, 52, 72, 82, 90 and 96 used in the previous examples utilize a core retaining pin 31, and FIGS. 39A and 39B are a side view and end view, respectively, of a core retaining pin 31. The core retaining pin 31 prevents forward longitudinal movement of the core. It also captures the single piece sleeve 86, 88, 92 and 94 preventing rear longitudinal movement.

Figure 41A:
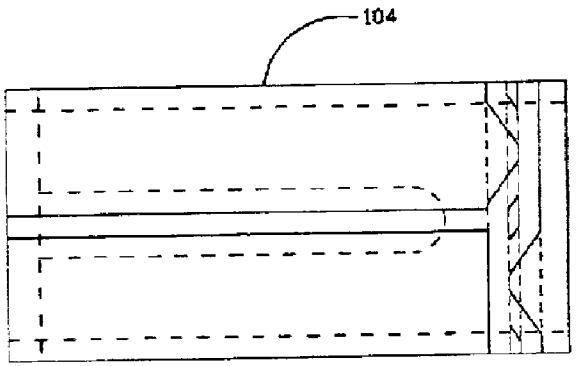
FIGS. 41A and 41B are a bottom view and end view, respectively, of the single piece sleeve (configuration of channel is mirror-image of FIG. 33A–C).
Figure 41B:
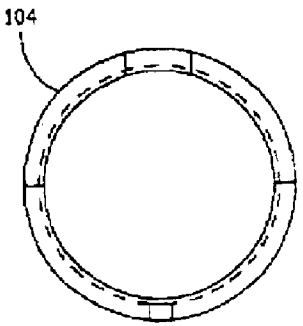
Figure 40B:
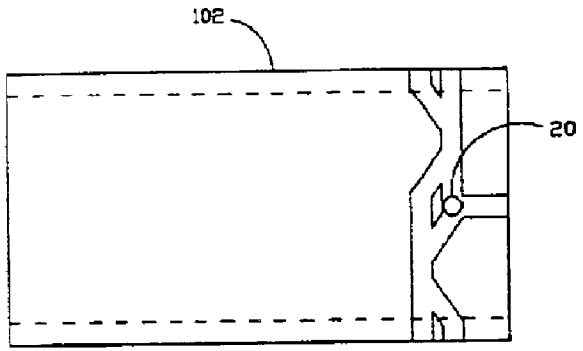
FIGS. 40A and 40B are a bottom view and end view, respectively, of the multi-piece sleeve's bottom portion (configuration of channel is mirror-image of FIGS. 6A–D).
Figure 40A:
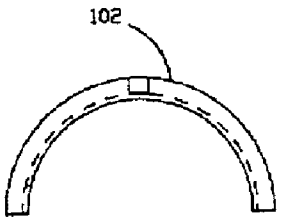

All previous examples refer to the fact that first position allows for insertion and removal of the keys, that the second position activates the blocking function and that the third position disables the blocking function. These positions do not specify direction of rotation (i.e. clockwise, counterclockwise). The direction of rotation (blocking function active or inactive) can be reversed by substituting the bottom portion of the multi-piece sleeve 42 (see FIGS. 6C & 6D) with a sleeve 102 having a channel design that is a mirror image. FIGS. 40A and 40B are a bottom view and end view, respectively, of the multi-piece sleeve's bottom portion in which the configuration of channel 40 is the mirror-image of FIGS. 6C & 6D. Likewise, for the single-piece sleeve 86 of FIGS. 33A–C, the direction of rotation (blocking function active or inactive) can be reversed by substituting the single piece sleeve 86 (see FIGS. 33A–C) with a sleeve 104 having a channel design that is a mirror image. Thus, FIGS. 41A and 41B are a bottom view and end view, respectively, of a single piece sleeve 104 in which the configuration of channel 40 is the mirror-image of that of FIGS. 33A–C.

Figure 43:
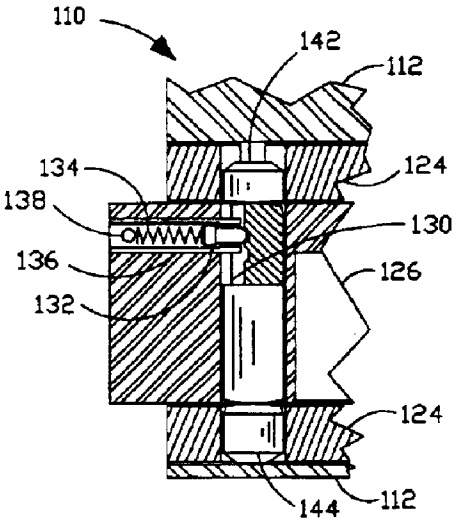
FIG. 43 is an exploded part-sectional view of the rear portion of the main body as in FIG. 42 and the short, medium and long locking pins with the blocking function inactivated.
Figure 42:
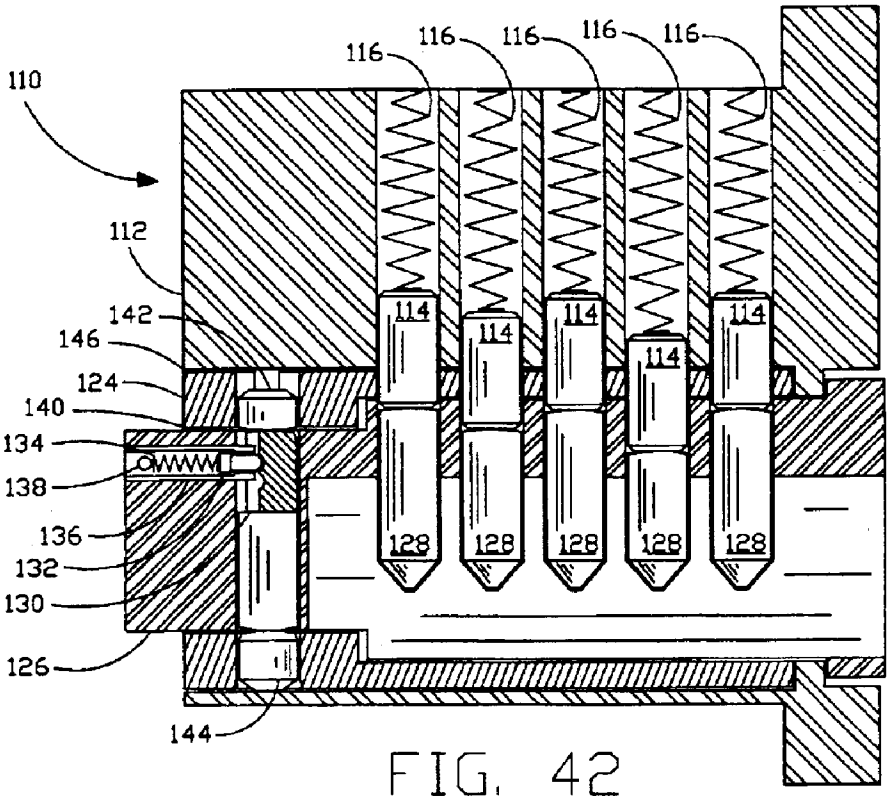
FIG. 42 is a part-sectional view of the main body according to an alternate embodiment of the invention with the blocking function inactivated in first position.
Figure 45:
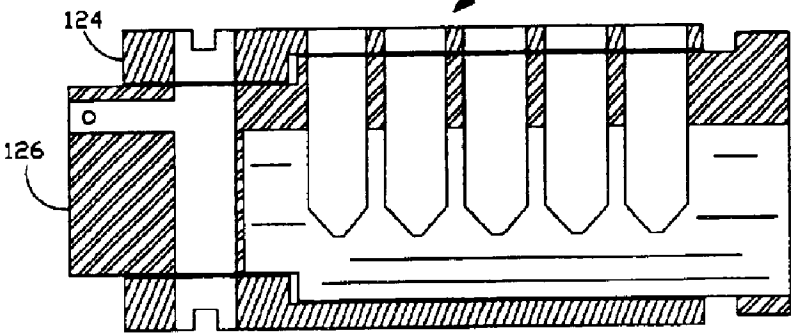
FIG. 45 is a part-sectional view of the cylinder.
Figure 44:
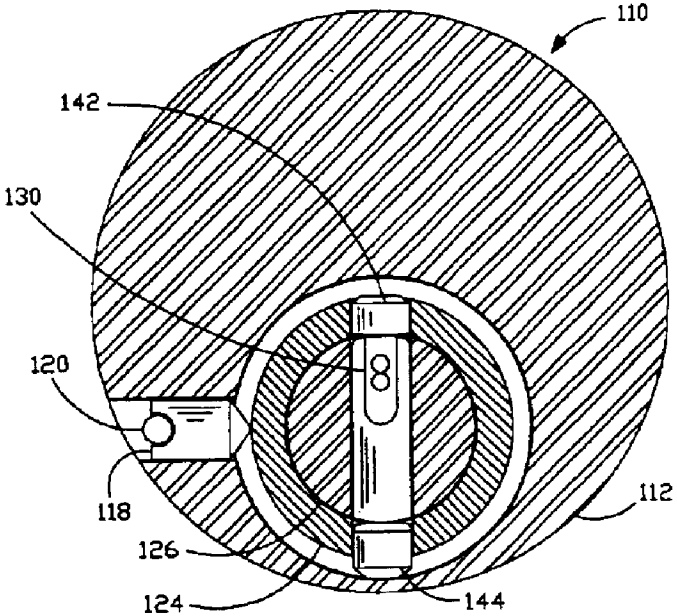
FIG. 44 is a perpendicular sectional view in the first position with blocking function inactivated.

Rather than a multi-piece sleeve 26 with both upper and lower portions 36, 42 as described above, FIGS. 42–57 illustrate an alternate embodiment that is based on the operations of locking pins. The alternate embodiment includes a main body assembly as shown in FIG. 42 designated generally by numeral 110. FIGS. 42, 43 and 44 depict a longitudinal and transverse view, respectively, of the main body 112 revealing all components. The components housed by the main body 112 include tumblers 114, tumbler springs 116, stationary driver 118, stationary driver retainer 120 and cylinder 122. The cylinder 122 consists of a sleeve 124 and core 126 (FIG. 45). The core 126 houses the drive tumblers 128, long locking pin 130, detent pin 132, detent pin spring 134, detent pin sleeve 136 and the detent pin retainer 138. The core 126 is separated from the sleeve 124 by a shear line 140 (FIG. 42). The sleeve 124 is a hollow cylindrical component (having a smaller inside diameter at the rear) which houses the short locking pin 142, medium locking pin 144 and is separated from the main body 112 by a second shear line 146. The sleeve 124 has a channel cut into its rear section. The stationary driver 118 is fixed to the main body 112 (held in place by the stationary driver retainer 120) and extends into the channel of the sleeve 124 (FIG. 44).

Figure 53:
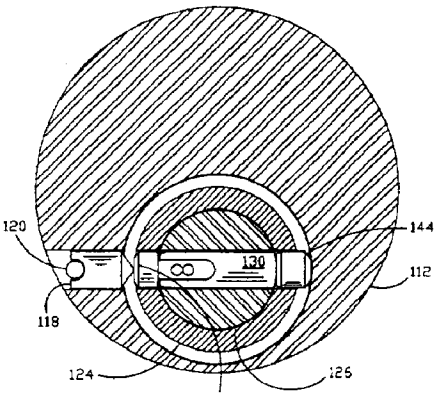
FIG. 53 is a perpendicular sectional view with Z key inserted and rotated to the third position with the blocking function inactivated.
Figure 52:
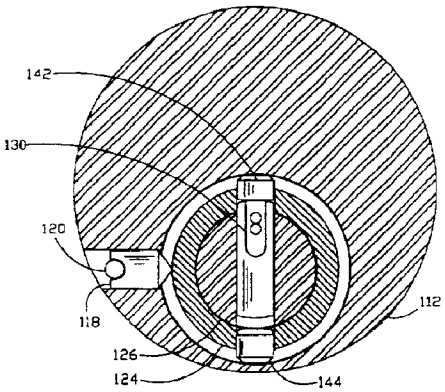
FIG. 52 is a perpendicular sectional view in the first position with the blocking function activated.
Figure 47:
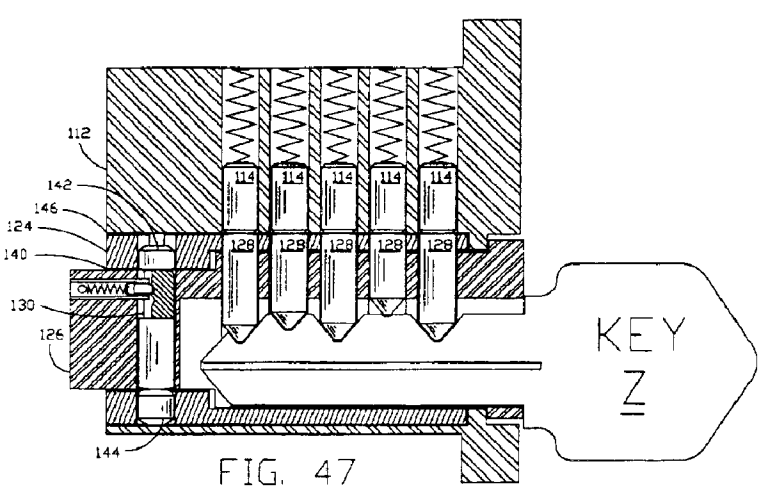
FIG. 47, as shown in FIG. 46, has Z key inserted with the blocking function inactivated in first position.
Figure 46:
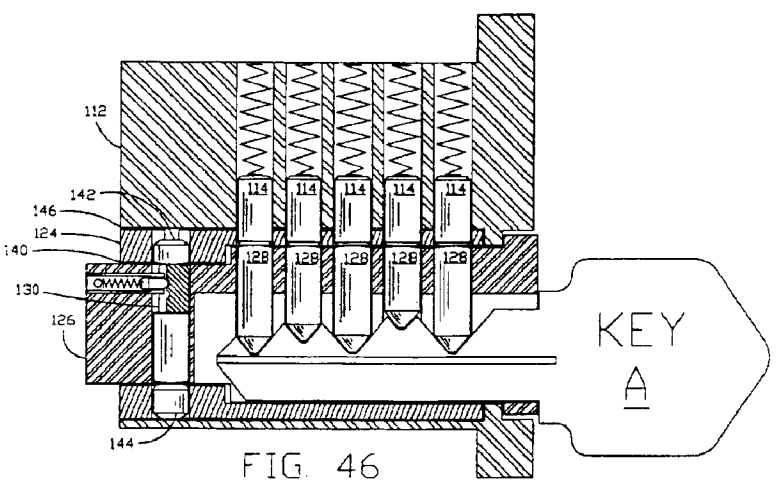
FIG. 46, as shown in FIG. 42, has A key inserted with the blocking function inactivated in first position.
Figure 48:
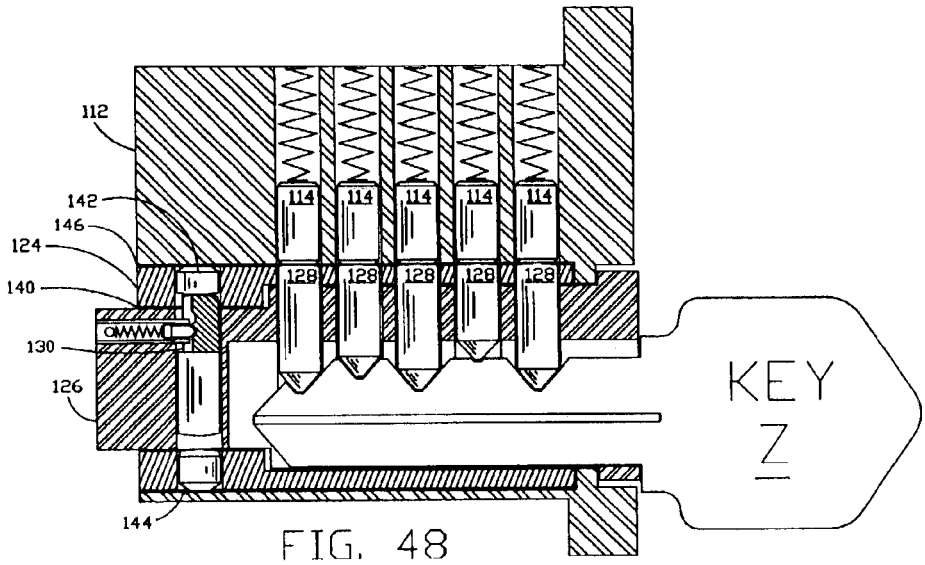
FIG. 48, as shown in FIG. 47, has the blocking function activated in first position.
Figure 49:
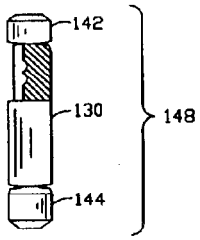
FIG. 49 is an exploded part-sectional view of the long, medium and short locking pins.
Figure 50:
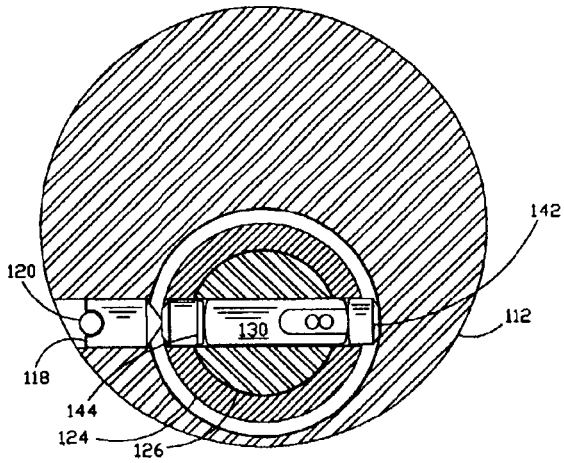
FIG. 50 is a perpendicular sectional view with Z key inserted and rotated to the second position with the blocking function activated.
Figure 51:
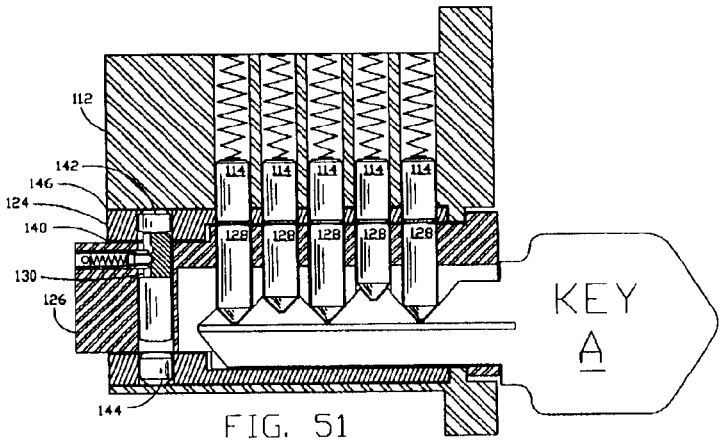
FIG. 51, as shown in FIG. 46, has A key inserted with the blocking function activated in first position.
Figure 54:
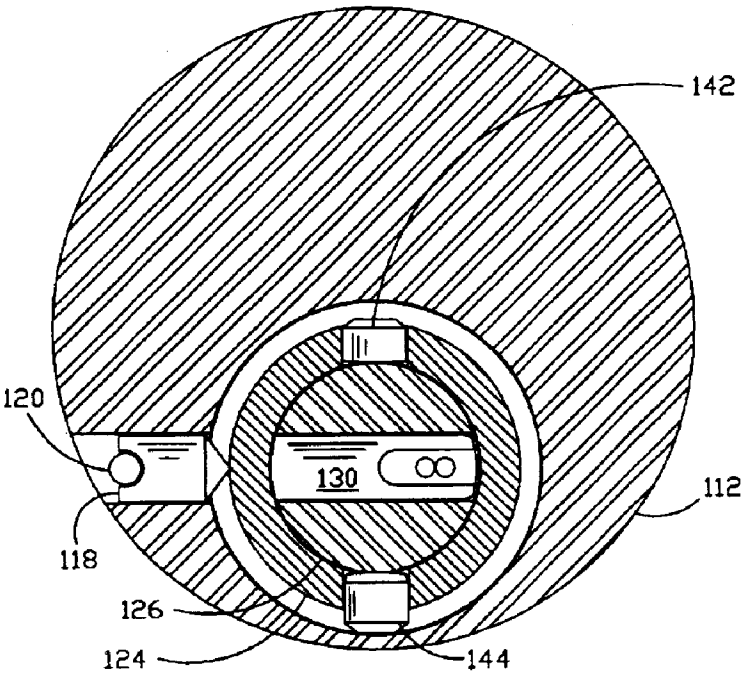
FIG. 54 is a perpendicular sectional view with A key inserted and rotated to the second position with the blocking function inactivated.

When the A key(s) is inserted into the core 126 (first position only), it aligns the gaps/breaks between the drive tumblers 128 and the tumblers 114 with shear line 140 (FIG. 46). When the Z key is inserted into the core 126 (first position only), it aligns the gaps/breaks between both the drive tumblers 128 and tumblers 114 with shear line 146 (FIG. 47). With the Z key still inserted into the core 126 and rotated to the second position, the core 126 and sleeve 124 (cylinder 122) rotate together. This is due to the gaps/breaks between both the drive tumbler 128 and tumblers 114 aligning with shear line 146 and not aligning with the second shear line 140 (FIG. 48). The rotation of the Z key to the second position causes the locking pins 148 (FIG. 49) to shift, thus extending them through shear line 140 located between the core 126 and the sleeve 124 (FIGS. 48, 50). This shift then locks the core 126 and sleeve 124 together (FIG. 48) thus activating the blocking function. Rotating the Z key from the second position back to the first position keeps the blocking function activated and allows for the removal of the Z key and insertion of the A key(s) into the core 126 (FIGS. 51, 52). With the A key(s) inserted, the gaps/breaks between the drive tumblers 128 and tumblers 114 are aligned with shear line 140 (FIG. 51). Normally, the A key(s) would be allowed to rotate the core 126, but due to the blocking function being activated, the A key(s) is inoperable (FIG. 51). With the Z key inserted into the core 126, the gaps/breaks between the drive tumbler 128 and tumblers 114 are aligned with shear line 146 (FIG. 48). Rotating the Z key to the third position, the core 126 and sleeve 124 (cylinder 122) rotate together (FIGS. 47, 53). The rotation of the Z key to the third position causes the locking pins 148 to shift (opposite direction) thus aligning them so that the gaps/breaks between them are aligned with the shear line 140 (FIG. 47) and inactivating the blocking function. Rotating the Z key from the third position back to the first position keeps the blocking function inactive and allows the removal of the Z key and the insertion of the A key(s) into the core 126 (FIG. 46). With the A key(s) inserted, the gaps/breaks between the drive tumblers 128 and the tumblers 114 are aligned with the shear line 140 (FIG. 46). The A key(s) is now allowed to rotate the core 126 (FIG. 54).

Figure 56:
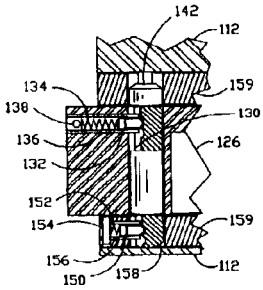
FIG. 56, as shown in FIG. 43, with the blocking function inactivated showing medium locking pin having detents.
Figure 57:
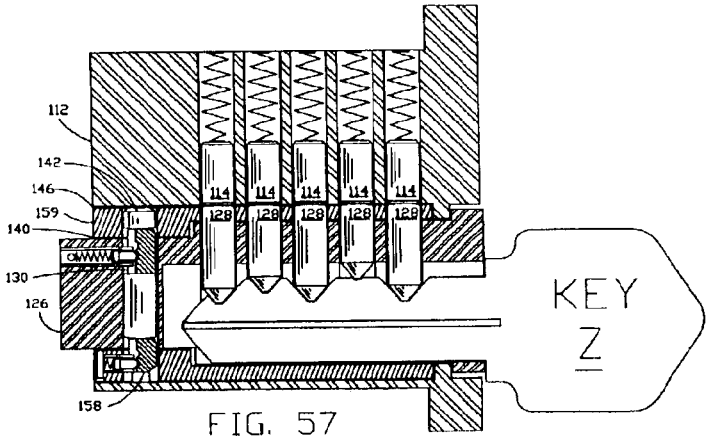
FIG. 57, as shown in FIG. 47, with the blocking function activated with medium locking pin having detents in first position.
Figure 55:
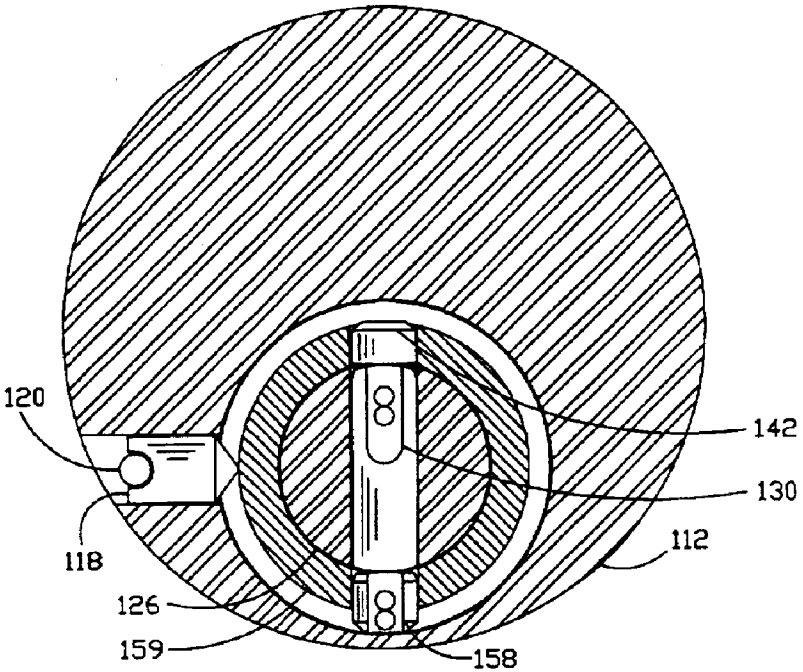
FIG. 55 is a perpendicular sectional view in the first position with the blocking function inactive and showing a medium locking pin having detents.

FIGS. 55–57 illustrate a variation on the alternate embodiment of FIGS. 42–54 which includes placement of a second detent pin 150, a second detent pin spring 152, a second detent pin retainer 154 and a second detent pin sleeve 156 acting on the new medium locking pin 158 housed in a new sleeve 159. This new medium locking pin 158 is designed to accept the second detent pin 150 (FIGS. 55, 56), thereby ensuring that the new medium locking pin 158 remains extended through the shear line 140 between the core 126 and the new sleeve 159 thus generating greater strength when the blocking function is activated (FIG. 57).

Having now fully set forth the preferred embodiments and certain modifications of the concept underlying the present invention, various other embodiments as well as certain variations and modifications of the embodiments herein shown and described will obviously occur to those skilled in the art upon becoming familiar with said underlying concept. It is to be understood, therefore, that the invention may be practiced otherwise than as specifically set forth in the appended claims.

What is claimed is:

1. A locking device, comprising:

a shell defined by a chamber, at least one bore hole extending into said chamber, and a tumbler slidably seated in said bore hole; and a cylinder inserted into the chamber of said shell, said cylinder further comprising, a core defined by a keyslot for accepting either one of a control key and a user key, said core also being defined by a radial bore hole corresponding to the bore hole in said shell, and a peripheral recess;

a multi-piece sleeve journalled within the recess of said core and defining a first shear line against said core and a second shear line against said shell, and a corresponding core tumbler slidably seated in the bore hole of said core and contacting the shell tumbler at a contact point;

whereby normal key operation includes insertion of said user key into the core to align said contact point with said first shear line to allow rotation of the core and opening of the locking device, but insertion of the control key in a first position aligns said contact point with said second shear line, and rotation of said control key to a second position initiates a blocking function which prevents said normal key operation.

2. The locking device according to claim 1, wherein insertion of said control key in said first position and rotation to a third position disables the blocking function.

3. The locking device according to claim 1, wherein normal key operation also includes insertion of said control key into the core to align said contact point with said second shear line to allow opening of the locking device.

4. A locking device, comprising:

a shell defined by a chamber and a first set of tumblers seated therein; and a cylinder inserted into the chamber of said shell, said cylinder further comprising, a core defined by an axial keyslot for accepting either one of a control key or a user key, and a sleeve around said core, and a set of core tumblers seated in the core and each contacting a corresponding shell tumbler at a contact point;

whereby normal key operation includes insertion of said user key into the core to align the contact points of said core tumblers and shell tumblers to allow opening of the locking device, but insertion of a control key in a first position realigns said contact point and rotation to a second position initiates a blocking function to prevent said user key operation.

5. The locking device according to claim 4, wherein insertion of said control key in said first position and rotation to a third position disables the blocking function.

6. The locking device according to claim 4, wherein normal key operation also includes insertion of said control key into the core to align said contact point with said second shear line to allow opening of the locking device.

7. A locking device, comprising:

a shell defined by a chamber, at least one bore hole extending into said chamber, and at least one corresponding spring-biased tumbler slidably seated in said at least one bore hole; and a cylinder inserted into the chamber of said shell, said cylinder further comprising, a core defined by an axial keyslot for accepting either one of a control key or a user key, at least one radial bore hole corresponding to the at least one bore hole in said shell, and a peripheral recess;

a multi-piece sleeve journalled within the recess of said core and rotatable about said core, said multi-piece sleeve defining a first shear line against said core and a second shear line against said shell, said sleeve comprising a first portion defined by at least one radial bore hole corresponding to the bore holes in said shell and core, and a second portion translatable along the core, and at least one corresponding core tumbler slidably seated in the at least one bore hole of said core and contacting the corresponding at least one shell tumbler at a contact point;

whereby normal key operation includes insertion of said user key into the core to align the contact point of said at least one core tumbler and said corresponding at least one shell tumbler to allow rotation of the core and opening of the locking device, but insertion of a control key in a first position realigns said contact point and rotation to a second position initiates a blocking function to prevent said user key operation.

8. The locking device according to claim 7, wherein insertion of said control key in said first position and rotation to a third position disables the blocking function.

9. The locking device according to claim 7, wherein normal key operation also includes insertion of said control key into the core to align said contact point with said second shear line to allow opening of the locking device.

10. A locking device, comprising:

a shell defined by a chamber, at least one bore hole extending into said chamber, at least one corresponding spring-biased tumbler slidably seated in said at least one bore hole, and a stationary drive pin anchored in said shell and protruding into said chamber; and a cylinder inserted into the chamber of said shell, said cylinder further comprising, a core defined by an axial keyslot for accepting both a control key and a user key, at least one radial bore hole corresponding to the at least one bore hole in said shell, and a peripheral recess;

a multi-piece sleeve journalled within the recess of said core, rotatable about said core, and defining a first shear line against said core and a second shear line against said shell, said sleeve comprising a first portion defined by at least one radial bore hole corresponding to the at least one bore holes in said shell and core, and a second portion rotatable about said core and translatable there along, said second portion having a guide track formed therein into which the stationary drive pin of said shell protrudes for guiding axial translation of said second portion in accordance with rotation of said cylinder, and at least one corresponding core tumbler slidably seated in the at least one bore hole of said core and contacting the corresponding at least one shell tumbler at a contact point;

whereby normal key operation includes insertion of said user key into the core to align said contact point of the core tumbler and corresponding at least one shell tumbler with said first shear line to allow rotation of the core and opening of the locking device, but insertion of a control key in a first position and rotation to a second position causes the stationary drive pin to shift the second portion of the multi-piece sleeve, thereby activating a blocking function to prevent said user key operation, and rotation of said control key to a third position causes the stationary drive pin to shift the second portion of the multi-piece sleeve back to deactivate said blocking function.

11. The locking device according to claim 10, wherein normal key operation also includes insertion of said control key into the core to align said contact point with said second shear line to allow opening of the locking device.

12. A locking device, comprising:

a shell defined by a chamber, at least one bore hole extending into said chamber, and a tumbler slidably seated in said bore hole; and a cylinder inserted into the chamber of said shell, said cylinder further comprising, a core defined by a keyslot for accepting either one of a control key and a user key, said core also being defined by a bore hole corresponding to the bore hole in said shell, a peripheral recess, and a core tumbler slidably seated in the bore hole of said core and contacting the shell tumbler at a contact point;

a sleeve journalled within the recess of said core and defining a first shear line against said core and a second shear line against said shell, said sleeve comprising a slot, and said slot corresponding to the bore holes of said shell and said core;

whereby normal key operation includes insertion of a user key into the core to align said contact point with said first shear line to allow rotation of the core and opening of the locking device, but insertion of a control key in a first position aligns said contact point with said second shear line, and rotation of said control key to a second position activates a blocking function to prevent said normal key operation.

13. The locking device according to claim 12, wherein insertion of said control key in said first position and rotation to a third position disables the blocking function.

14. The locking device according to claim 12, wherein normal key operation also includes insertion of said control key into the core to align said contact point with said second shear line to allow opening of the locking device.

15. A locking device, comprising:

a shell defined by a chamber, at least one bore hole extending into said shell, and at least one corresponding spring-biased tumbler slidably seated in said at least one bore hole; and a cylinder inserted into the chamber of said shell, said cylinder further comprising, a core defined by an axial keyslot for accepting either one of a control key or a user key, at least one radial bore hole corresponding to the at least one bore hole in said shell, and a peripheral recess;

a unitary sleeve journalled within the recess of said core and defining a first shear line against said coreand a second shear line against said shell, said sleeve comprising a radial slot corresponding to the at least one bore hole in said shell and core, and said sleeve being rotatable about said core and translatable there along, and at least one corresponding core tumbler slidably seated in the at least one bore hole of said core and contacting the corresponding at least one shell tumbler at a contact point;

whereby normal key operation normally includes insertion of the user key into the core to align said contact point with said first shear line for rotation of the core and opening of the locking device, but insertion of a control key in a first position aligns said contact point with said second shear line, and rotation of said control key to a second position initiates a blocking function that prevents said normal key operation.

16. The locking device according to claim 15, wherein insertion of said control key in said first position and rotation to a third position disables the blocking function.

17. The locking device according to claim 15, wherein normal key operation also includes insertion of said control key into the core to align said contact point with said second shear line to allow opening of the locking device.

18. A locking device, comprising:

a shell defined by a chamber, a bore hole extending from said chamber into said shell, a spring-biased tumbler slidably seated in said bore hole, and a stationary drive pin anchored in said shell and protruding into said chamber; and a cylinder inserted into the chamber of said shell, said cylinder further comprising, a core defined by an axial keyslot for accepting both a control key and a user key, a radial bore hole corresponding to the bore hole in said shell, a peripheral recess, and a core tumbler slidably seated in the radial bore hole of said core and contacting the shell tumbler at a contact point;

a unitary sleeve journalled within the recess of said core and defining a first shear line against said core, a second shear line against said shell, a slot corresponding to the bore hole in said shell and the radial bore hole of said core, and a guide track formed therein into which the stationary drive pin of said shell protrudes for guiding axial translation of the unitary sleeve in accordance with rotation of said cylinder, and a guide track formed therein into which the stationary drive pin of said shell protrudes for guiding axial translation of the unitary sleeve in accordance with rotation of said cylinder, and whereby normal key operation normally includes insertion of the user key into the core to align said contact point of the core tumbler and shell tumbler with said first shear line to allow rotation of the core and opening of the locking device, and insertion of a control key in a first position and rotation to a second position causes the stationary drive pin to shift the unitary sleeve, thereby activating a blocking function to prevent said normal key operation, and rotation of said control key to a third position causes the stationary drive pin to shift the unitary sleeve back to deactivate said blocking function.

19. The locking device according to claim 18, wherein normal key operation also includes insertion of said control key into the core to align said contact point with said second shear line to allow opening of the locking device.

20. A locking device for replacement of an existing main body of a lock, comprising:

a replacement cylinder and shell for insertion into said lock, said replacement cylinder further comprising, a core defined by a keyslot for accepting either one of a control key and a user key;

a sleeve journalled into said core and defining a first shear line and a second shear line;

whereby normal key operation includes insertion of the user key into the core to align said contact point with said first shear line for rotation of the core and opening of the locking device, but insertion of a control key in a first position aligns said contact point with said second shear line, and rotation of said control key to a second position initiates a blocking function that prevents said normal key operation.

21. The locking device according to claim 20, wherein insertion of said control key in said first position and rotation to a third position disables the blocking function.

22. The locking device according to claim 20, wherein normal key operation also includes insertion of said control key into the core to align said contact point with said second shear line to allow opening of the locking device.

23. A locking device, comprising:

a replacement cylinder for insertion into a lock, said replacement cylinder further comprising, a core defined by a keyslot for accepting either one of a control key and a user key;

a sleeve journalled into said core and defining a first shear line and a second shear line;

whereby normal key operation entails insertion of a user key into the core to rotate the core and open the locking device, but insertion of a control key in a first position and rotation to a second position activates a blocking function to prevent said normal key operation.

24. The locking device according to claim 23, wherein insertion of said control key in said first position and rotation to a third position disables the blocking function.

25. The locking device according to claim 23, wherein normal key operation also includes insertion of said control key into the core to align said contact point with said second shear line to allow opening of the locking device.

26. A locking device, comprising:

a shell defined by a chamber, at least one bore hole extending from said chamber into said shell, at least one corresponding spring-biased tumbler slidably seated in said bore hole, and a stationery driver anchored in said shell and protruding into said chamber;

a cylinder inserted into the chamber of said shell, said cylinder further comprising, a core defined by a keyslot for accepting both a control key and a user key, at least one radial bore hole corresponding to the bore hole in said shell, and a locking pin bore hole;

a sleeve surrounding said core, the sleeve being defined by a radial bore hole corresponding to the bore holes in said core and said shell, and opposing locking pin bore holes;

a locking pin slidably seated in the locking pin bore hole of the core; and a detent pin for locking said locking pin in position;

whereby a control key inserted into the core and rotated therein locks the core and sleeve together to activate a blocking function to prevent access using said user key.

* * * * *